US009109446B1

(12) United States Patent
Knezek

(10) Patent No.: US 9,109,446 B1
(45) Date of Patent: Aug. 18, 2015

(54) CONTINUOUSLY VARIABLE DISPLACEMENT ENGINE

(75) Inventor: Robert A. Knezek, Arlington, TX (US)

(73) Assignee: Ameriband, LLC, Arlington, TX (US)

( * ) Notice: Subject to any disclaimer, the term of this patent is extended or adjusted under 35 U.S.C. 154(b) by 659 days.

(21) Appl. No.: 13/368,198

(22) Filed: Feb. 7, 2012

Related U.S. Application Data

(60) Provisional application No. 61/462,700, filed on Feb. 7, 2011.

(51) Int. Cl.

| | |
|---|---|
| ***F01B 3/02*** | (2006.01) |
| ***F01B 3/10*** | (2006.01) |
| ***F01B 3/00*** | (2006.01) |
| ***F04B 1/29*** | (2006.01) |

(52) U.S. Cl.
CPC ..... *F01B 3/102* (2013.01); *F01B 3/0023* (2013.01); *F04B 1/295* (2013.01)

(58) Field of Classification Search
CPC ..... F01B 3/102; F01B 3/0023; F04B 1/295
USPC ..... 92/12.1, 12.2, 13, 71
See application file for complete search history.

(56) References Cited

U.S. PATENT DOCUMENTS

| | | | | |
|---|---|---|---|---|
| 1,788,609 | A * | 1/1931 | Andrews | 74/60 |
| 1,910,054 | A * | 5/1933 | Rayburn | 60/451 |
| 2,532,254 | A * | 11/1950 | Bouchard | 74/60 |
| 4,094,202 | A | 6/1978 | Kemper | |
| 4,100,815 | A | 7/1978 | Kemper | |
| 4,117,736 | A | 10/1978 | Kemper et al. | |
| 4,433,596 | A * | 2/1984 | Scalzo | 74/839 |
| 4,497,284 | A * | 2/1985 | Schramm | 123/41.47 |
| 5,513,553 | A * | 5/1996 | Gleasman et al. | 92/12.2 |
| 5,553,582 | A * | 9/1996 | Speas | 123/56.4 |
| 5,782,219 | A | 7/1998 | Frey et al. | |
| 5,955,291 | A | 9/1999 | Alitalo et al. | |
| 6,397,794 | B1 | 6/2002 | Sanderson et al. | |
| 6,446,587 | B1 | 9/2002 | Sanderson et al. | |
| 6,460,450 | B1 | 10/2002 | Sanderson et al. | |
| 6,694,931 | B2 | 2/2004 | Palmer | |
| 6,829,978 | B2 | 12/2004 | Sanderson et al. | |
| 6,854,377 | B2 | 2/2005 | Sanderson et al. | |
| 6,883,416 | B2 * | 4/2005 | Koelzer et al. | 92/12.2 |
| 6,913,447 | B2 | 7/2005 | Fox et al. | |
| 6,915,765 | B1 | 7/2005 | Sanderson et al. | |

(Continued)

FOREIGN PATENT DOCUMENTS

| | | | |
|---|---|---|---|
| CN | 101749122 | A | 6/2010 |

*Primary Examiner* — Dwayne J White
*Assistant Examiner* — Matthew Wiblin
(74) *Attorney, Agent, or Firm* — Howison & Arnott, LLP

(57) ABSTRACT

A variable displacement engine comprises a block having one or more cylinders disposed in parallel around a rotating power shaft. A piston in each cylinder is connected to a connecting rod. A wobble plate, including a first ring, a second ring and a bearing assembly, is mounted on the shaft. The first ring rotates with the shaft and pivots about a pivot axis. The second ring is concentrically adjacent the first ring, has rod bearings connected to each connecting rod, and is connected to the block to prevent relative rotation. The bearing assembly is connected between the rings to allow relative rotation therebetween while constraining the rings to remain parallel. A displacement actuator connected to the wobble plate moves the pivot axis along the shaft to change the displacement, while a piston control linkage changes the wobble plate angle to maintain a constant compression ratio.

20 Claims, 13 Drawing Sheets

(56) References Cited

U.S. PATENT DOCUMENTS

| | | | | |
|---|---|---|---|---|
| 6,925,973 | B1 | 8/2005 | Sanderson et al. | |
| 6,968,751 | B2 | 11/2005 | Shulenberger et al. | |
| 7,007,589 | B1 | 3/2006 | Sanderson | |
| 7,011,469 | B2 | 3/2006 | Sanderson et al. | |
| 7,040,263 | B2 | 5/2006 | Sanderson et al. | |
| 7,140,343 | B2 | 11/2006 | Sanderson | |
| 7,153,105 | B2 * | 12/2006 | Koelzer et al. | 417/53 |
| 7,162,948 | B2 | 1/2007 | Sanderson et al. | |
| 7,185,578 | B2 | 3/2007 | Sanderson | |
| 7,270,092 | B2 | 9/2007 | Hefley | |
| 7,325,476 | B2 * | 2/2008 | Sanderson | 92/12.2 |
| 7,331,271 | B2 | 2/2008 | Sanderson et al. | |
| 7,334,548 | B2 | 2/2008 | Sanderson et al. | |
| 7,409,932 | B2 | 8/2008 | Gaiser | |
| 7,438,029 | B2 | 10/2008 | Fox et al. | |
| 2007/0245992 | A1 | 10/2007 | Hefley | |
| 2009/0107327 | A1 * | 4/2009 | Ota et al. | 92/13 |
| 2010/0278463 | A1 * | 11/2010 | Becker et al. | 384/2 |

* cited by examiner

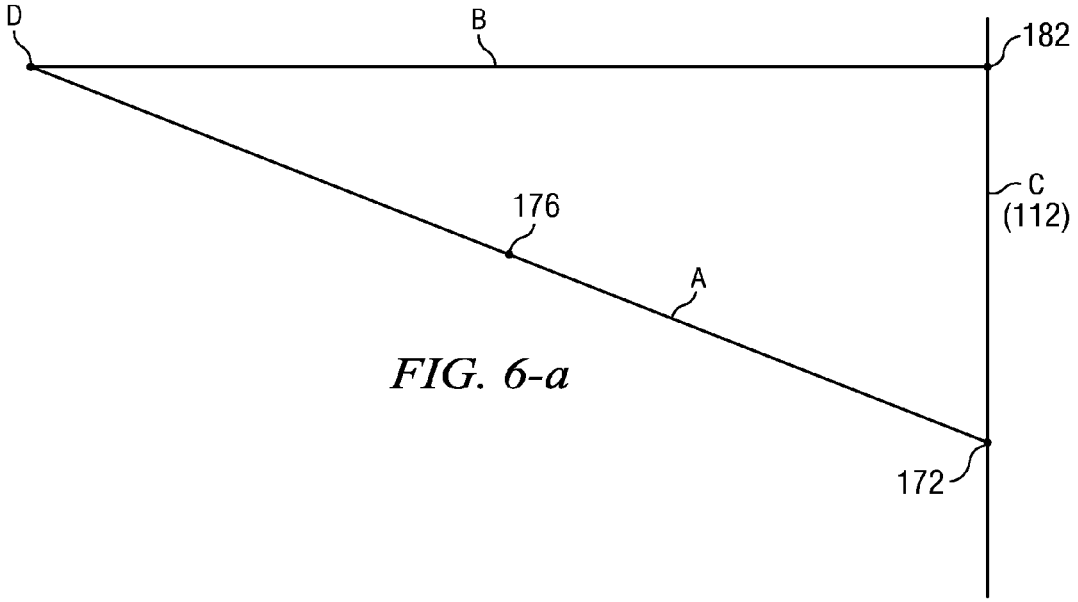
FIG. 6-a
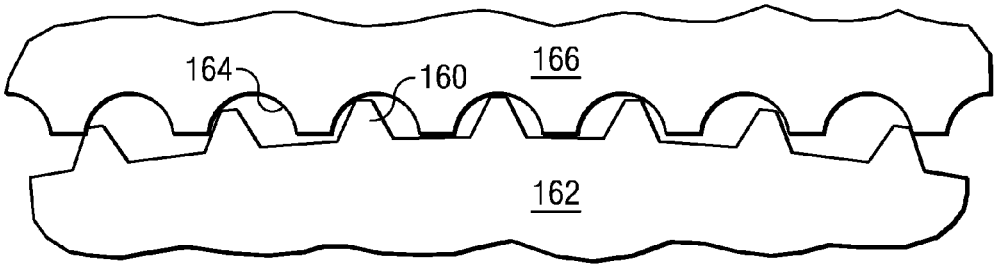
FIG. 6-b

CONTINUOUSLY VARIABLE DISPLACEMENT ENGINE

CROSS-REFERENCE TO RELATED APPLICATIONS

This patent application claims benefit of U.S. Provisional Application No. 61/462,700, filed Feb. 7, 2011, entitled CONTINUOUSLY VARIABLE DISPLACEMENT ENGINE, the specifications of which are incorporated herein in their entirety.

TECHNICAL FIELD

The present invention relates to an internal combustion piston engine having a wobble plate or swash plate. In particular, it relates to a wobble plate engine in which the piston displacement can be continuously varied over a range of displacements while maintaining a constant compression ratio.

BACKGROUND

Current internal combustion engines typically use one or more pistons in single, opposed, in-line or V arrangements. They use a crankshaft where the piston is connected to a crankshaft through a connecting rod. The crankshaft has one or more bearings offset from the center of the shaft that drive the pistons back and forth as the shaft turns to ingest and exhaust gases contained by the piston in a cylindrical space in the engine block. They operate with a constant displacement and constant compression ratio. Thus they are essentially constant displacement engines. Some attempts (such as in some Cadillac and Honda automobiles) have been made to vary displacement by inactivating use of certain cylinders in a multi-piston engine. The engine displacement is changed in discontinuous steps limiting fuel efficiency over a continuously variable displacement engine. Also, the frictional losses are not reduced in this design at reduced power and engine control becomes more complex.

Aircraft engines have also been designed with multiple pistons arranged in a radial manner around a single offset bearing on the crank shaft. This arrangement is used when high torque is required and the engine speed (rotations per minute) is not very high.

High speed rotary compressors and turbines have also been used in engine designs, primarily in aircraft applications, where air is drawn through the engine, mixed with fuel and combustion is internal to the engine. These applications are generally not suitable for land vehicle or industrial uses because of cost and low fuel efficiency.

Many factors affect the useful power that is produced by an internal combustion engine. The five main variables for a piston engine are the engine displacement, speed (rotations per minute), compression ratio, inlet air pressure and fuel-to-air ratio. Thermodynamic principles indicate that for an internal combustion engine of fixed displacement, maximum fuel efficiency (ratio of useful power to fuel consumed) of traditional engines occurs near the conditions of maximum inlet air pressure, which is also near the maximum power setting for a given engine speed. In internal combustion engine applications, the common method of controlling power produced is to lower intake pressure until the desired power level is produced. Thus the engine is normally operating at reduced efficiency.

U.S. Pat. No. 5,553,582, issued to Speas, shows an engine based on the wobble plate concept wherein the engine design is capable of varying engine displacement, cylinder compression ratio, valve timing and valve travel. The Speas design may be considered very complex, and may not be practical for an operational engine. The complex mechanisms in the Speas patent required to achieve all the variables are not needed in a fuel efficient engine and may prevent the design from being implemented.

SUMMARY

One embodiment comprises a 4-stroke piston engine with one or more cylinders arranged around a central straight power shaft. The axes of the cylinders are parallel to the axis of the power shaft. A piston control mechanism is linked to the power shaft at a variable angle with respect to the power shaft axis. The piston control mechanism transforms the forces from the piston(s) into torque to turn the power shaft. As the displacement is continuously varied, the top of the piston stroke is automatically varied to maintain a constant compression ratio throughout the full range of displacement. Maintaining a constant compression ratio throughout the range of piston displacement permits the engine to maintain full intake air pressure and maximum fuel efficiency over a wide range of power demand.

In a preferred embodiment, the range of engine displacement can be continuously and smoothly varied over at least a range of 3:1. In another preferred embodiment, lesser power demand is met by restricting intake air flow and fuel (limiting intake air pressure) at minimum displacement. Variations in valve timing are readily achieved by a simple actuation mechanism. This combination of engine features improves fuel efficiency over conventional designs in applications wherein the engine will routinely operate at various power demands.

In still other embodiments, an engine is provided having numerous advantages over conventional designs in addition to those previously described. In some embodiments, the engine requires a small spatial envelope. In other embodiments, the engine weight is reduced by the structural efficiency of the straight power shaft, structural efficiency of the engine block and reduction of weight in the pistons and connecting rods due to lower side forces. In other embodiments, the inertial forces are also lower because of the reduced weight and the feature that the primary inertial mode is balanced in multi-piston engine configurations.

In still other embodiments, an engine is provided that is readily scalable and is readily adapted to other piston control mechanism configurations. In various embodiments, the engine can accommodate up to five cylinders with little change in engine spatial envelope over a single cylinder design. In other embodiments, the engine competes favorably with much more complicated and costly hybrid power trains (i.e., combined internal combustion and electrical) in automotive engine systems. In other embodiments, the engine provides improved fuel efficiency may be even more important in large truck applications, especially for long cross-country routes where fuel costs are a high part of the transportation cost. In other embodiments, two or more sets of pistons can also be grouped together in various arrangements.

In still other embodiments, hydraulically powered valve lifters (rather than conventional cams) and/or a hydraulic piston replacement for the mechanical piston control mechanism actuator may offer further improvements. In other embodiments, hydraulic valve actuation permits an electronic engine control unit to vary valve timing and/or valve open duration and/or rate of valve opening and closing and/or valve travel.

In another embodiment, an engine comprises an engine block, an elongated power shaft rotatably supported by the engine block, the power shaft having a longitudinal axis, and at least one cylinder supported by the engine block. Each cylinder has a bore defining a bore axis aligned substantially parallel to the longitudinal axis of the power shaft. The engine of this embodiment further comprises one or more pistons corresponding in number to the number of the cylinders, each respective piston being slidably disposed within the bore of a respective cylinder. The engine of this embodiment further comprises a wobble plate assembly having a generally annular configuration defining a central opening through which central opening the power shaft passes, the wobble plate assembly including a central support member, a first ring portion, a second ring portion and a ring bearing assembly. The central support member is longitudinally slidably mounted on the power shaft and defines a pivot axis for the wobble plate assembly. The pivot axis intersects the longitudinal axis of the power shaft in a perpendicular orientation and rotates with the power shaft. The first ring portion is pivotally mounted on the central support member such that the first ring portion pivots about the pivot axis and rotates with the central support member. The second ring portion is concentrically disposed adjacent the first ring portion and has mounted thereon one or more connecting rod bearings corresponding in number to the number of the cylinders. The ring bearing assembly is connected between the first ring portion and the second ring portion so as to allow the first ring portion to rotate about the common center relative to the second ring portion while constraining the second ring portion to remain parallel to the first ring portion. The wobble plate assembly, when viewed in a direction parallel to the pivot axis, defines a wobble plate inclination plane and a wobble plate inclination angle θ, the wobble plate inclination plane being seen as a line passing through the center of the pivot axis and the center of the connecting rod bearing(s), when viewed in a direction parallel to the pivot axis, and the wobble plate inclination angle θ being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and the central support member, the displacement actuator selectively moving the central support member along the power shaft so as to longitudinally position the pivot axis of the wobble plate assembly at a user-selectable distance d from a theoretical zero displacement point on the longitudinal axis. The engine of this embodiment further comprises a piston control linkage operatively connected to the wobble plate assembly, the piston control linkage setting the wobble plate inclination angle θ as the distance d changes so as to maintain a linear relationship between d and sin(θ) such that $d=W \sin(\theta)$, where W is a constant. The engine of this embodiment further comprises an anti-rotation assembly having a first portion operatively connected to the second ring portion of the wobble plate assembly and a second portion operatively connected to the engine block, the anti-rotation assembly preventing rotation of the second ring portion of the wobble plate assembly relative to the engine block. The engine of this embodiment further comprises a torque assembly having a first portion operatively connected to the first ring portion of the wobble plate assembly and a second portion operatively connected to the power shaft, the torque assembly transmitting torque between the first ring portion and the power shaft to cause rotation of the power shaft relative to the engine block when the first ring portion rotates relative to the engine block. The engine of this embodiment further comprises one or more connecting rods corresponding in number to the number of cylinders, each respective connecting rod having an upper end connected to a respective piston and a lower end connected to a respective connecting rod bearing on the second ring member of the wobble plate assembly such that reciprocation of the piston(s) within the cylinder bore(s) results in rotation of the power shaft. Operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

In another embodiment, an engine comprises an engine block supporting a plurality of cylinders spaced apart around a rotatably mounted central power shaft having a longitudinal axis, each respective cylinder having a respective bore defining a bore axis aligned substantially parallel to the longitudinal axis and having a respective piston slidably disposed therein, each respective piston having connected thereto an upper end of a respective connecting rod also having a lower end. The engine of this embodiment further comprises a wobble plate assembly mounted on the power shaft, the wobble plate assembly including a first ring portion, a second ring portion and a ring bearing assembly. The first ring portion is operatively mounted on the power shaft such that the first ring portion rotates with the power shaft and pivots about a pivot axis intersecting the longitudinal axis of the power shaft in a perpendicular orientation and rotating with the power shaft. The second ring portion is concentrically disposed adjacent the first ring portion and has mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block. The ring bearing assembly is connected between the first ring portion and the second ring portion so as to allow the first ring portion to rotate about the common center relative to the second ring portion while constraining the second ring portion to remain parallel to the first ring portion. Reciprocation of the pistons within the cylinder bores results in rotation of the power shaft. The wobble plate assembly, when viewed in a direction parallel to the pivot axis, defines a wobble plate inclination plane and a wobble plate inclination angle θ, the wobble plate inclination plane being seen as a line passing through the center of the pivot axis and the center of the connecting rod bearings, when viewed in a direction parallel to the pivot axis, and the wobble plate inclination angle θ being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and the wobble plate assembly, the displacement actuator selectively moving the wobble plate assembly along the power shaft so as to longitudinally position the pivot axis of at a user-selectable distance d from a theoretical zero displacement point on the longitudinal axis. The engine of this embodiment further comprises a piston control linkage operatively connected to the wobble plate assembly, the piston control linkage setting the wobble plate inclination angle θ as the distance d changes such that d=W sin(θ), where W is a constant. Operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

In another embodiment, an engine comprises an engine block supporting a plurality of cylinders spaced apart around a rotatably mounted central power shaft having a longitudinal axis, each respective cylinder having a respective bore defining a bore axis aligned substantially parallel to the longitudinal axis and having a respective piston slidably disposed therein, each respective piston having connected thereto an upper end of a respective connecting rod also having a lower end. The engine of this embodiment further comprises a wobble plate assembly mounted on the power shaft, the wobble plate assembly including a first ring portion, a second ring portion and a ring bearing assembly. The first ring portion is operatively mounted on the power shaft such that the first ring portion rotates with the power shaft and pivots about a pivot axis intersecting the longitudinal axis of the power shaft in a perpendicular orientation and rotating with the power shaft. The second ring portion is concentrically disposed adjacent the first ring portion and has mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block. The ring bearing assembly is connected between the first ring portion and the second ring portion so as to allow the first ring portion to rotate about the common center relative to the second ring portion while constraining the second ring portion to remain parallel to the first ring portion. Reciprocation of the pistons within the cylinder bores results in rotation of the power shaft. The wobble plate assembly, when viewed in a direction parallel to the pivot axis, defines a wobble plate inclination plane and a wobble plate inclination angle, the wobble plate inclination plane being seen as a line passing through the center of the pivot axis and the center of the connecting rod bearings, when viewed in a direction parallel to the pivot axis, the wobble plate inclination angle being the angle of intersection between the wobble plate inclination plane and a line perpendicular to the longitudinal axis of the power shaft, when viewed parallel to the pivot axis. The engine of this embodiment further comprises a displacement actuator operatively connected between the engine block and pivot axis, the displacement actuator selectively moving the wobble plate assembly along the power shaft so as to longitudinally position the pivot axis within a range of positions along the longitudinal axis. The engine of this embodiment further comprises a piston control linkage operatively connected to the wobble plate assembly, the piston control linkage setting the wobble plate inclination angle as the longitudinal position of the pivot axis changes to maintain a constant compression ratio. Operation of the displacement actuator to selectively change the longitudinal position of the pivot axis within a range between a first position and a second position correspondingly changes the piston displacement of the engine within a range between a maximum displacement and a minimum displacement.

BRIEF DESCRIPTION OF THE DRAWINGS

For a more complete understanding, reference is now made to the following description taken in conjunction with the accompanying drawings, in which:

FIG. 6-*a* is a schematic side view of an engine in accordance with another aspect illustrating the geometry of the engine reference plane;

FIG. 6-*b* is a schematic view of gear tooth profiles illustrating one embodiment of the anti-rotation assembly;

DETAILED DESCRIPTION

Figure 1:
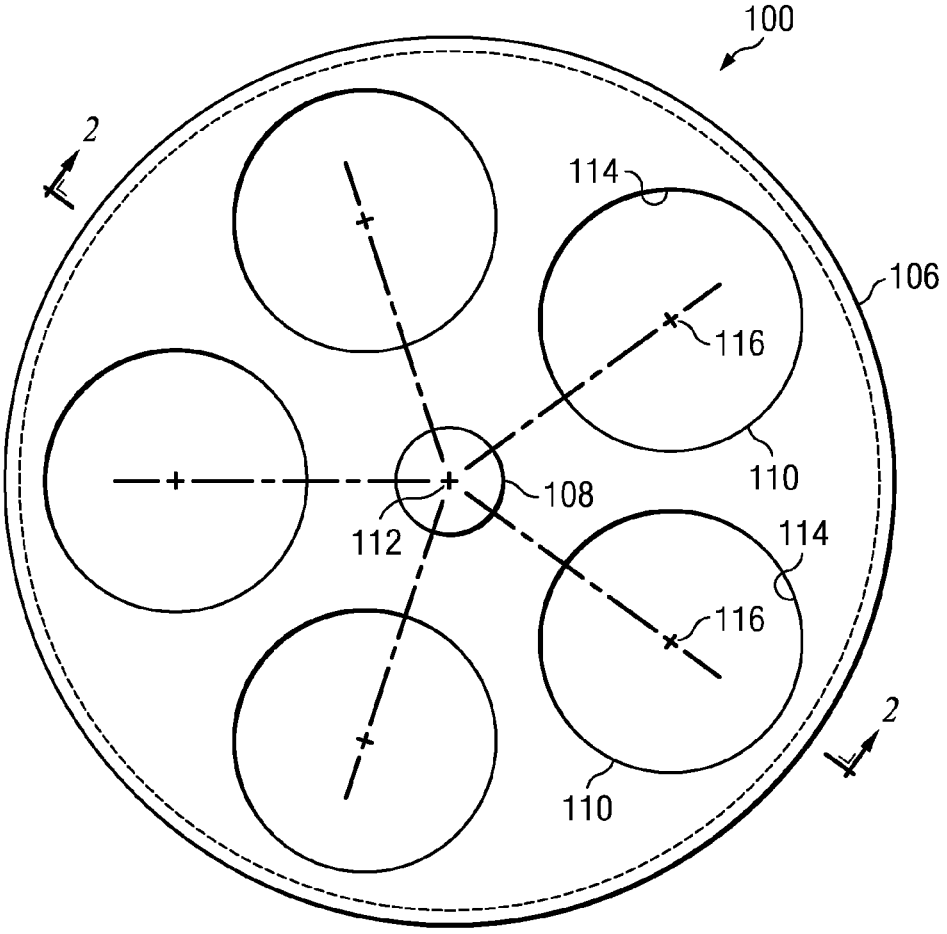
FIG. 1 is a simplified cross-sectional top view of an engine according to one embodiment taken along line 1-1 of FIG. 2.

Referring now to the drawings, wherein like reference numbers are used herein to designate like elements throughout, the various views and embodiments of continuously variable displacement engine are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Description of a First Exemplary Embodiment

Figure 2:
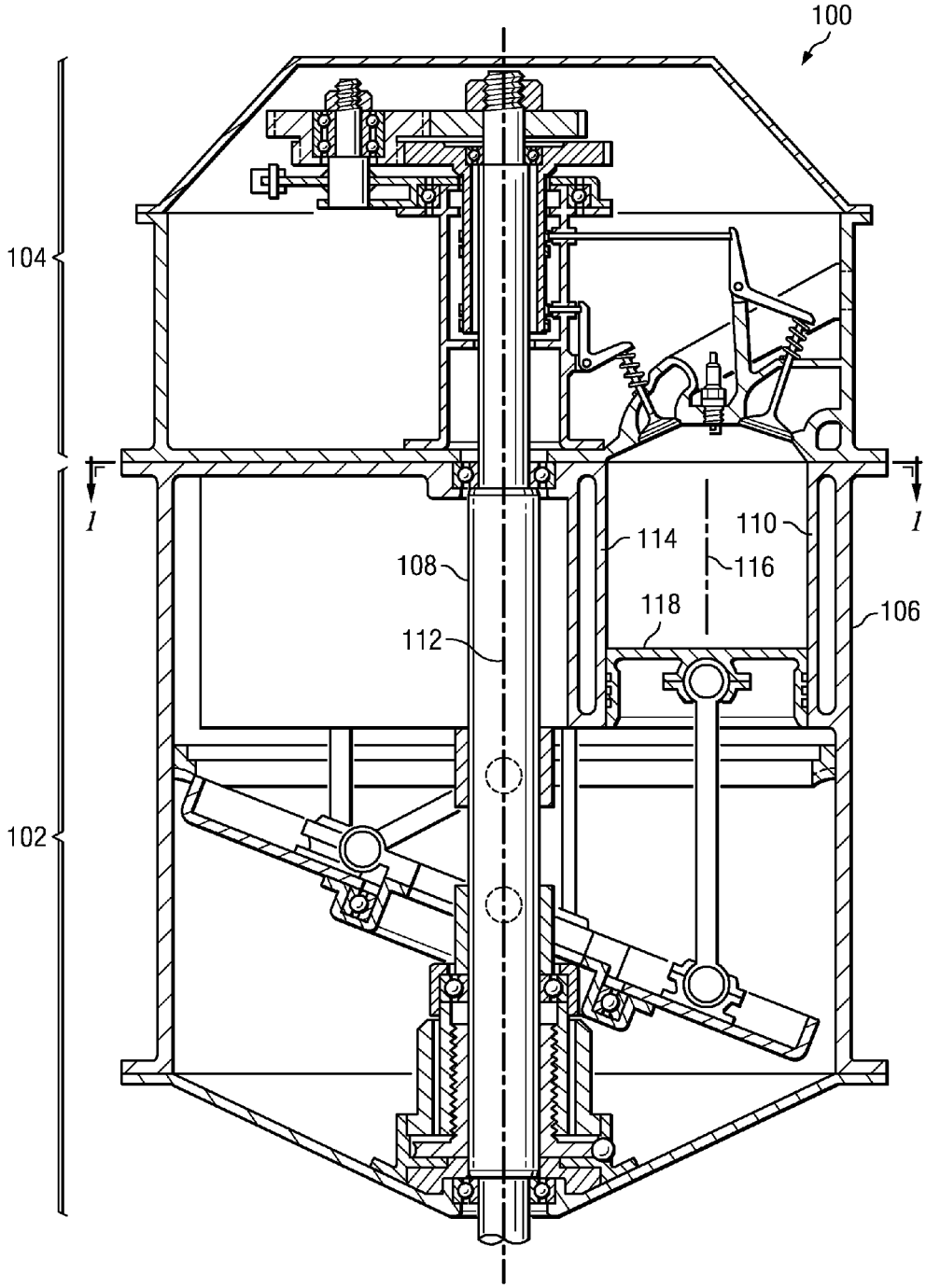
FIG. 2 is a cross-sectional side view of the engine of FIG. 1 taken along line 2-2 of FIG. 1.
Figure 3:
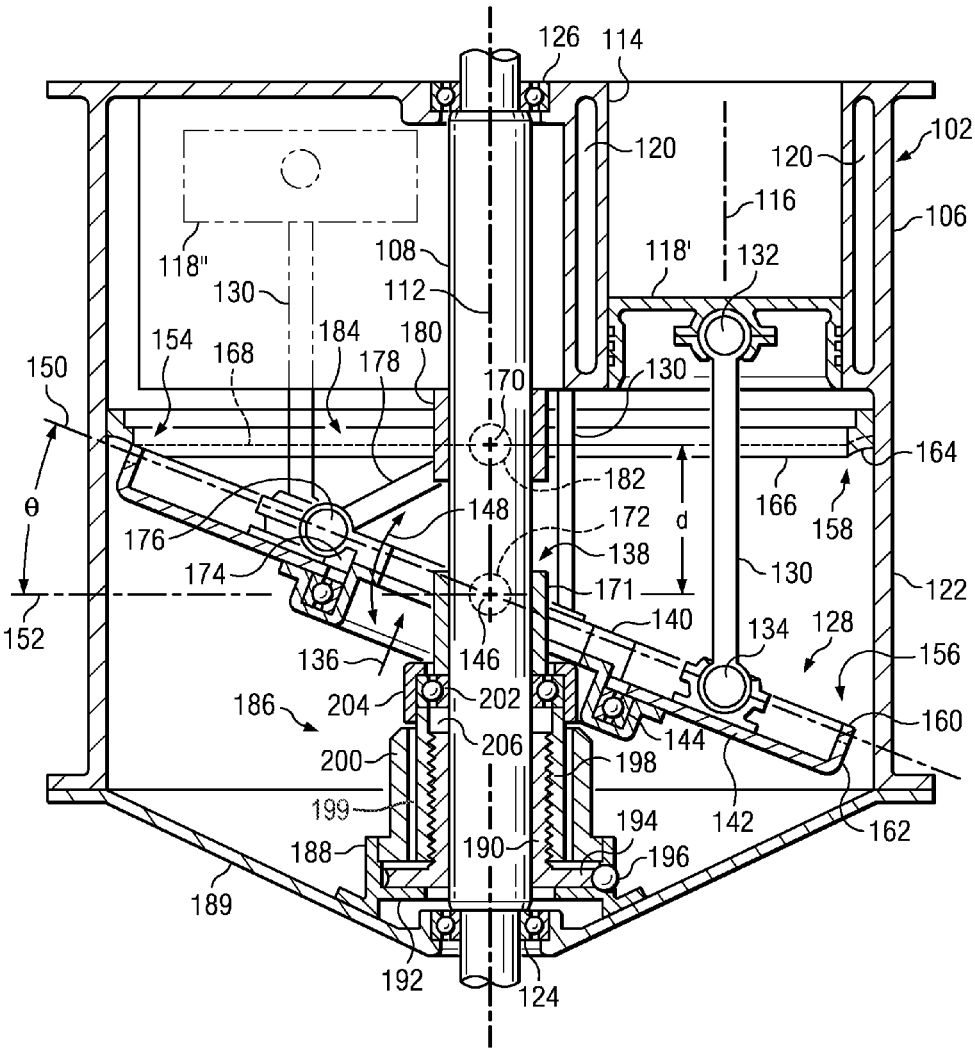
FIG. 3 is a cross-sectional side view of the engine block portion of the engine of FIG. 2.
Figure 4:
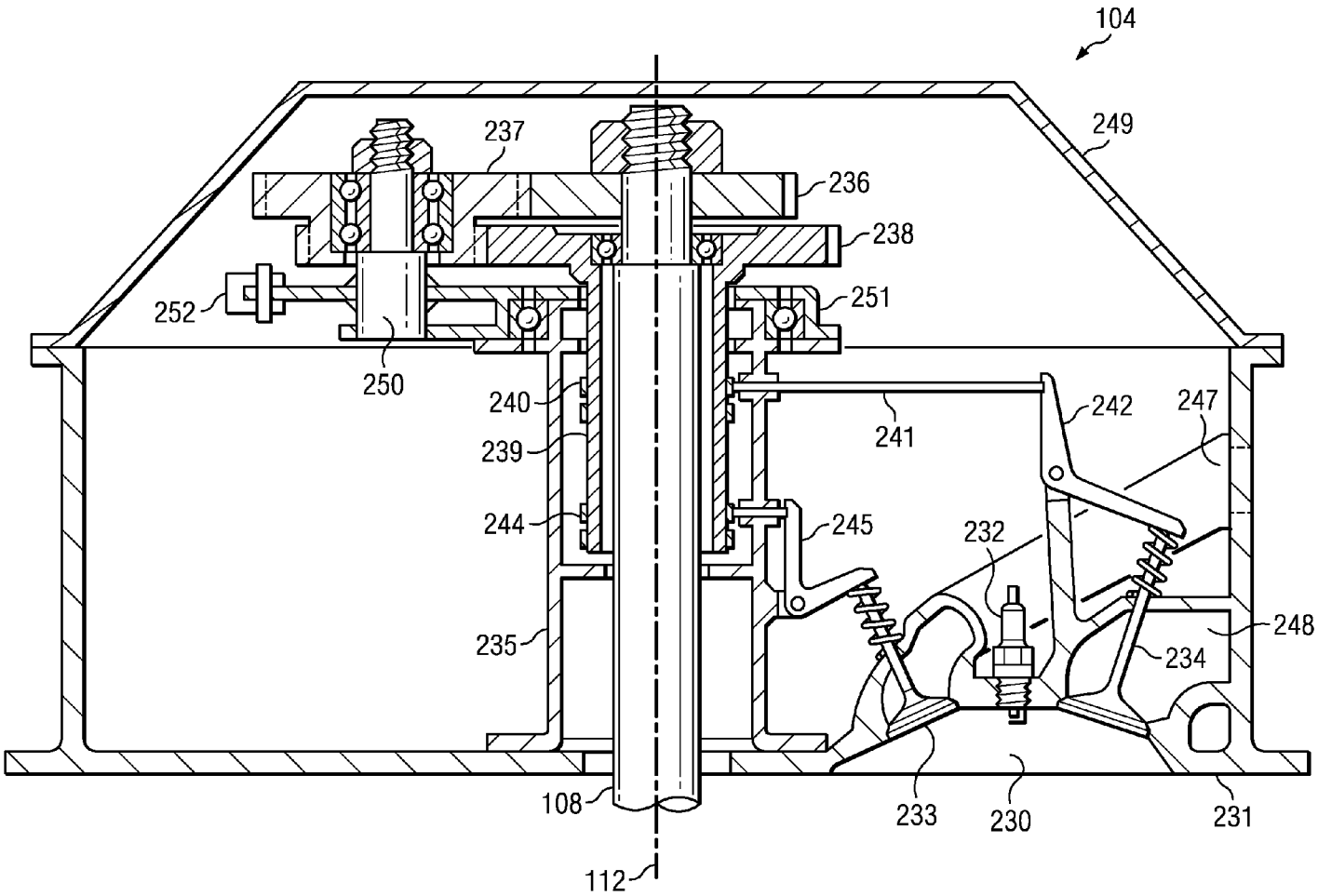
FIG. 4 is a cross-sectional side view of the cylinder head portion of the engine of FIG. 2.

Referring to FIGS. 1-4, there is illustrated a variable displacement engine 100 in accordance with a first exemplary embodiment of the invention. FIG. 1 provides a simplified cross-sectional top view of the engine 100, FIG. 2 provides an overall cross-sectional side view of the engine 100, FIG. 3 provides a cross-sectional side view of the engine block assembly 102 including the cylinders, power shaft and piston control mechanism and FIG. 4 shows the cylinder head assembly 104 and its internal components.

Referring now specifically to FIG. 1, engine 100 comprises an engine block 106, a power shaft 108 rotatably supported by the engine block and at least one cylinder 110 supported by the engine block. The elongated power shaft 108 defines a longitudinal axis 112 running through both the power shaft and the engine block 106. Each cylinder 110 has a bore 114 defining a bore axis 116 aligned substantially parallel to the longitudinal axis 110 of the power shaft 108. The engine 100 illustrated in FIG. 1 has five cylinders 112 evenly spaced around the central shaft 108; however, other embodiments of the engine may have different numbers of cylinders (including a single cylinder) and/or have the cylinders spaced differently around the power shaft.

Referring now also to FIG. 2, the illustrated engine 100 is configured with the cylinder head assembly 104 mounted on top of the engine block assembly 102. In the illustrated embodiment, the power shaft 108 extends from the engine block assembly 102 into the cylinder head assembly 104; however, in other embodiments of the engine the power shaft may be differently arranged. A piston 118 is slidably disposed within the bore 114 of each respective cylinder 110.

Referring now to FIG. 3, the engine block assembly 102 is illustrated in more detail. The engine block 106 (also called the "cylinder block") is the major support structure for the internal components and may include coolant passages 120 for the cylinders 110. An outer wall 122 of the cylinder block 106 may have a cylindrical configuration for structural efficiency. The power shaft 108 may be mounted in the cylinder block 106 by bearings 124 and 126. The pistons 118 are attached to a non-rotating portion of a ring-like wobble plate assembly 128 by connecting rods 130. In FIG. 3, three of the connecting rods 130 are visible. Spherical connecting rod bearings 132 and 134 are provided at the respective upper and lower ends of each connecting rod 130 to permit the necessary freedom of relative motion for the connected components. In FIG. 3, one piston (denoted 118') is illustrated at the bottom of its stroke, and another piston (denoted 118", shown partially in hidden line) is illustrated near the top of the stroke.

The wobble plate assembly 128 has a generally annular (i.e., ring-like) configuration defining a central opening 136. In the illustrated embodiment, the power shaft 108 passes through the central opening 136. The wobble plate assembly 128 includes a central support member 138, a first ring portion 140, a second ring portion 142 and a ring bearing assembly 144. The central support member 138 is longitudinally slidably mounted on the power shaft 108, but rotates around the longitudinal axis 112 with the power shaft. The central support member 138 defines a pivot axis 146 for the wobble plate assembly 128. The pivot axis 146 intersects the longitudinal axis 112 in a perpendicular orientation and also rotates with the power shaft 108. The first ring portion 140 is pivotally mounted on the central support member 138 such that the first ring portion 140 pivots (as denoted by arrow 148) about the pivot axis 146; however, the first ring portion also rotates around the longitudinal axis 112 with the central support member 138 and the power shaft 108. The second ring portion 142 is concentrically disposed adjacent the first ring portion 140. Mounted on the second ring portion 142 are the lower connecting rod bearings 134. As will be further described herein, the second ring portion 142 does not rotate around the longitudinal axis 112 with the power shaft 108. The ring bearing assembly 144 is connected between the first ring portion 140 and the second ring portion 142 so as to allow the first ring portion to rotate about the common center relative to the second ring portion while constraining the second ring portion to remain parallel with the first ring portion.

Referring still to FIG. 3, the wobble plate assembly 128, when viewed in a direction parallel to the pivot axis 146, defines a wobble plate inclination plane (denoted by reference number 150) and a wobble plate inclination angle θ. When viewed in a direction parallel to the pivot axis 146, the wobble plate inclination plane 150 is seen as a line passing through the center of the pivot axis 146 and the center(s) of the lower connecting rod bearings 134; however, that line corresponds to the edge of the wobble plate plane 150 collectively defined by the centers of the lower connecting rod bearings 134. The wobble plate inclination angle θ is the angle of intersection between the wobble plate inclination plane 150 and a plane (denoted by reference number 152) perpendicular to the longitudinal axis 112 of the power shaft 108, when viewed parallel to the pivot axis. As will be further described herein, the wobble plate inclination angle θ determines the engine displacement (also called "piston displacement") of the engine 100 for each full rotation of the power shaft 108.

As previously described, the second ring portion 142 of the wobble plate assembly 128 does not rotate with the power shaft 108. Rotation of the second ring portion 142 is prevented by an anti-rotation assembly 154 having a first anti-rotation portion 156 operatively connected to the second ring portion and a second anti-rotation portion 158 operatively connected to the engine block 106. In the embodiment of FIG. 3, the first anti-rotation portion 156 includes a first plurality of teeth 160 disposed on the outer rim 162 of the second ring portion 142, and the second anti-rotation portion 158 includes a second plurality of teeth 164 disposed on a stationary ring gear 166 fixedly mounted on the engine block 106. In the illustrated embodiment, the engagement of the teeth 160 and 164 occurs substantially where the wobble plate inclination plane 150 intersects a control plane (denoted by reference number 168), the control plane 168 being a plane oriented perpendicular to the longitudinal axis 112 positioned at the theoretical zero displacement point (denoted by reference number 170). Determination of the position of the theoretical zero displacement point 170 is further described herein, e.g., in relation to FIG. 5. That the intersection of teeth 160 and 164 may occur in the control plane 168 and at the same distance from the center of the second ring portion 142 is further described below. As the power shaft 108 rotates, the highest part the second ring portion 142 remains continuously engaged with the ring gear 166 and prevents the second ring portion from rotating relative to the engine block 106. It will be appreciated that the teeth 160 and 164 may have non-standard profile(s) so as to accommodate differences in the pitch of the teeth of outer rim 162 and gear 166. The tooth profiles may also need to accommodate the change in angle and radial location of the outer rim 162 as the wobble plate inclination angle θ changes to vary piston displacement. An example of gear tooth configurations to accommodate the difference in tooth pitches is described in connection with FIG. 6-*b*.

Referring still to FIG. 3, the non-rotating second ring portion 142 of the wobble plate assembly 128 is attached by the ring bearing assembly 144 to the first ring portion 140, which rotates with the power shaft 108 as previously described. The first ring portion 140 is pivotally attached to the central support member 138 defining the pivot axis 146. In the illustrated embodiment, the central support member 138 includes a support collar 171 and two pivot bearings 172, one disposed on each side of the support collar along the pivot axis 146. The support collar 171 is permitted to slide axially (i.e., longitudinally) along the power shaft 108. A short arm 174 mounted on the first ring portion 140 extends to a control bearing 176, which in turn connects the first ring portion to one end of a control link 178. The other end of the control link 178 is attached to an upper collar 180 by two upper bearings 182, one on each side of the upper collar. In the illustrated embodiment, the upper bearings 182 are disposed on the longitudinal axis 112 at the theoretical zero displacement point 170. Upper collar 180 is attached firmly to the power shaft 108 to prevent movement axially and relative rotation about the power shaft. The control link 178 assures that the first ring portion 140 rotates with the drive shaft 108.

The control link 178 between bearings 182 and 176 together with the first ring portion 140 between bearings 176 and 172 forms a three point linkage comprising a piston control linkage 184 for the illustrated embodiment. The piston control linkage 184 changes the wobble plate inclination angle θ as the pivot axis 146 moves along the longitudinally axis 112 so as to maintain a constant compression ratio independent of engine displacement. The specific dimensions and/or positions of the elements making up the piston control linkage 184 may be determined by considering the minimum desired combustion chamber volume (i.e., with the pistons 118 at maximum upward travel), piston diameter, maximum wobble plate inclination angle, and the distance from the longitudinal axis 112 (i.e., center of power shaft 108) to the lower connecting rod bearings 134. An example of this determination is described in connection with FIG. 5.

It will be appreciated that the configuration of the piston control linkage may be different in other embodiments. However, regardless of the configuration, the piston control linkage produces a constant compression ratio independent of engine displacement by maintaining a linear relationship between a distance d and sin(θ) as the pivot axis 146 moves, where d is the distance (measured along the longitudinal axis 112) between the location of the pivot axis 146 and the theoretical zero displacement point 170, and θ is the wobble plate inclination angle. Put another way, the piston control linkage ensures that θ and d change simultaneously such that $d=W\cdot\sin(\theta)$, where W is a constant. This relationship assures that the compression ratio is independent of engine displacement, as further illustrated and described in connection with FIG. 5.

Referring still to FIG. 3, the piston displacement of the engine 100 may be varied by moving the pivot axis 146 of the wobble plate assembly 128 axially along the power shaft 108 using a displacement actuator 186. In the illustrated embodiment, the displacement actuator 186 is a screw jack device and the pivot axis 146 is carried by the support collar 171; however, the configuration of these elements may be different in other embodiments. The displacement actuator 186 surrounds the power shaft 108 and is mounted on a base 188 to a lower cover 189 of the engine block 106. An inner member 190 of the actuator surrounds the power shaft 108 and has external threads. The bottom of the inner member 190 is restrained by a thrust ring 192 that is part of the base 188. A lower flange 194 of the inner member 190 includes an external gear that is operatively engaged by a screw gear 196 to selective rotate the inner member in order to operate the screw jack and vary the engine displacement. The inner member 190 threadingly engages an internally threaded lift cylinder 198. The lift cylinder 198 is restrained from rotating by tines 199 or other restraining elements (not shown) that mate with an external housing 200. The housing 200 is firmly attached to the base 188, and the base of the housing also restrains the inner member 190 so that it does not lift off the base 188. The lift cylinder 198 acts against a lift bearing 202. An outer collar 204 retains the lift cylinder 198 to the lift bearing 202. The lift bearing is also attached to support collar 171 by an internal collar 206, which is attached to an extension of the support collar that passes through the inside of the lift bearing. The upper collar 180 and the lift cylinder 198 of the screw jack device 186 also serve as mechanical stops to limit the range of engine displacement.

Referring now to FIG. 4, the cylinder head assembly 104 of this embodiment is illustrated in more detail. The cylinder head assembly 104 includes a cylinder head 231 that attaches to the engine block assembly 102 (shown in FIG. 2) and defines one or more head cavities 230 to enclose the area above each cylinder 110 of the engine block. For purposes of clarity, the valves and porting structure corresponding to only one cylinder 110 (e.g., for cylinder 1) are shown in FIG. 4. The hardware for the remaining cylinders 110 (e.g., for cylinders 2, 3, 4 and 5) is similar and spaced around the power shaft 108 in a similar manner to the cylinders shown in FIG. 1. The ignition device 232, intake valve 233 and exhaust valve 234 are located in the top of the combustion chamber.

A cam support structure 235 is attached to the cylinder head 231 concentric to the power shaft 108. In this embodiment, cam reduction gears 236, 237, and 238 are provided to synchronize the rotation of a cam body 239 with the rotation of the power shaft 108 and reduce the rotation rate of the cam body to one-half the rotation rate of the power shaft as required for a 4-stroke engine. A first cam 240 depresses the exhaust valve 234 for the first cylinder through a push rod 241 and a rocker arm 242. A second cam 244 depresses the intake valve 233 for the first cylinder through a rocker arm 245. Corresponding intake and exhaust valves, cams and actuating linkages (not shown) are provided for the remaining cylinders, but are not illustrated in FIG. 4 for purposes of clarity.

During engine operation a fuel/air mixture enters the cylinder head 231 through an intake port 247. Exhaust gases are discharged through an exhaust port 248. The top of the cylinder head assembly is enclosed by a valve cover 249.

In the illustrated embodiment, the valve timing may be varied by rotating the position of the cam reduction gear 237 around the power shaft 108. The cam reduction gear 237 is mounted on a support structure 250. A bearing 251 permits the support structure 250 with the cam reduction gear 237 to rotate about the support structure 235 and the power shaft 108. Rotation of the support structure 250 may be controlled by an external actuator 252.

Design Process Example

As previously indicated, the details of a mechanism suitable to maintain a constant pressure ratio in an internal combustion engine having a variable displacement depend on several design parameters. An example is now provided to demonstrate the process of calculating the design details for a particular embodiment. This design process example is based on estimated parameters (not optimized) for a gasoline fueled engine with five cylinders and a compression ratio of 4.804 (i.e., pressure ratio of 9.00). The selected pistons and cylinders are 4.00 inches in diameter. The selected distance from the power shaft centerline to the piston/cylinder centerline is 4.00 inches.

The selected range of variable displacement of the example design is to allow the engine to operate within a range between a maximum displacement DPmax of 3.0 liters and a minimum displacement DPmin of 1.0 liter, i.e., the "size" of the engine at minimum displacement being ⅓ the size of the engine at the maximum displacement. For the engine operating at the DPmin displacement of 1.0 liter, each piston displacement is calculated to be 12.205 cubic inches, and the corresponding piston stroke is calculated to be 0.971 inches. The required combustion chamber volume at the top of the piston stroke is 3.208 cubic inches (with the top of the piston assumed to be in the same plane as the bottom of the cylinder head).

For the engine operating at the DPmax displacement of 3.0 liter, with a piston diameter unchanged at 4.00 inches, the required displacement of each piston is 36.615 cubic inches, and the corresponding stroke for each piston is calculated to be 2.914 inches. The required combustion chamber volume of each cylinder head with the piston at the top of the compression stroke is calculated to be 9.625 cubic inches. Since the combustion chamber volume of the head is only 3.208 cubic inches when the piston top is level with the bottom of the cylinder head (as assumed in the previous step), an additional combustion chamber volume of 6.417 cubic inches must be provided by lowering the top of the piston stroke to 0.511 inches below the cylinder head.

Figure 5:
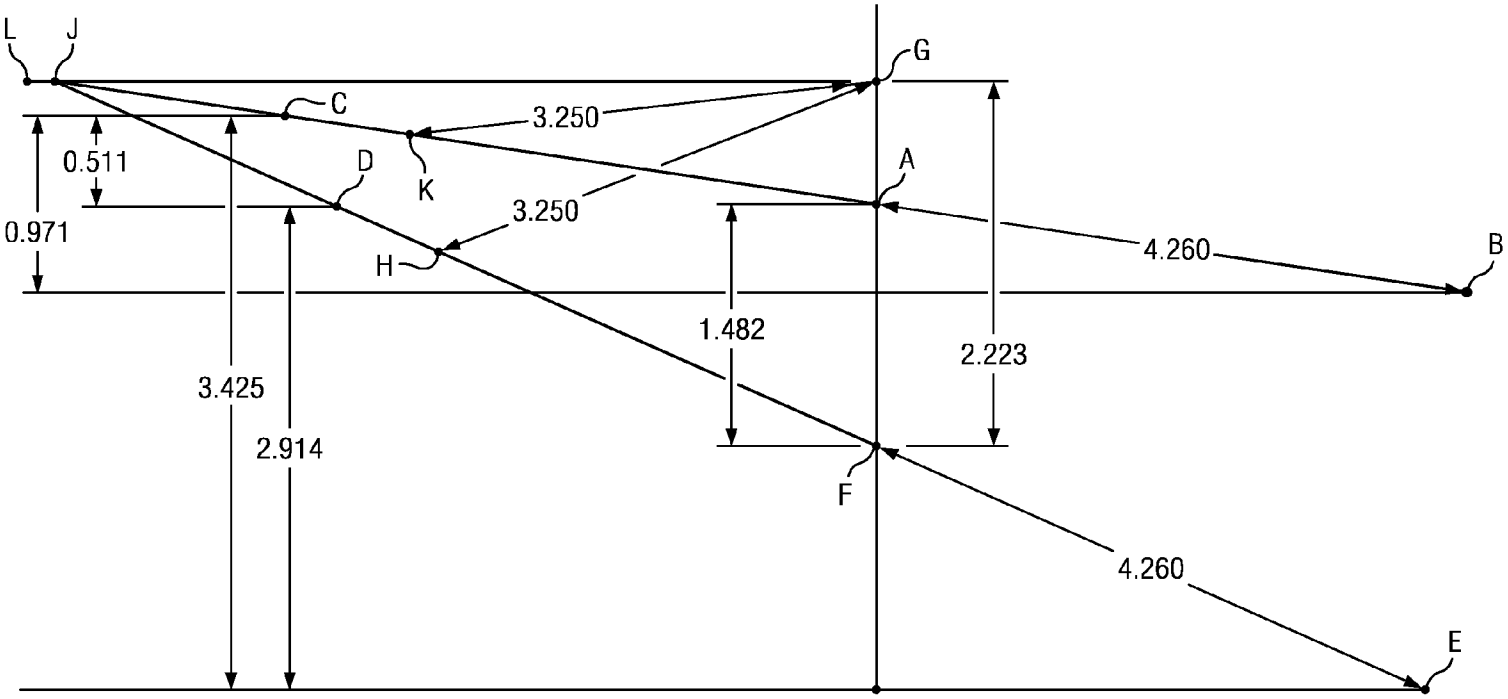
FIG. 5 is a schematic side view of an engine in accordance with another aspect illustrating the geometry of the wobble plate assembly at different values of displacement.

Referring now to FIG. 5, a schematic diagram is provided of the engine 100 of FIGS. 1-4 depicting primarily the power shaft and wobble plate assembly. FIG. 5 shows how the displacement/compression ratio control mechanism (also called the piston control mechanism) described in connection with FIGS. 1-3 achieves the required characteristics for the design process example. The reference numbers from FIGS. 1-3 are used to refer to the corresponding features of FIGS. 1-3.

Point A in FIG. 5 represents the location of the pivot axis 146 (i.e., the center of the pivot bearing 172) on the sliding collar 171 for the engine operating at the minimum piston displacement (DPmin) of 1.0 liter. This location, at the centerline of power shaft 108 (shown by line G-A-F), is selected so that there will be no interference between the parts of the piston control mechanism and the fixed parts of the cylinder block 106. As previously described, the support collar 171 slides along the power shaft 108, thereby moving the pivot bearing 172 to vary the engine displacement. At the (DPmin) 1.0 liter level of engine displacement, the stroke of each piston is 0.971 inches. The location of the center of connecting rod lower bearing 134 at the bottom of the piston stroke (i.e., when the section of the wobble plate directly under the rod bearing is lowest) is shown as point B, and the location of the same rod bearing at the top of the piston stroke (i.e., when the section of the wobble plate directly under the rod bearing is highest) is shown hypothetically as point C. The line through points B and C thus represents the wobble plate plane 150 passing through the centers of the connecting rod lower bearings 134 on the second ring portion in FIG. 3 with the engine operating at 1.0 liter engine displacement. It will be appreciated that in actuality, point C for each cylinder occurs directly above point B after the power shaft/first ring portion of the piston control mechanism has rotated 180 degrees, but for purposes of explanation and illustration it is it represented at the opposite end of the wobble plate line. It was previously assumed that, when the piston is at the top of the stroke for the engine at the 1.0 liter engine displacement, the top of the piston is in the same plane as the bottom of the cylinder head and the combustion chamber volume is 3.208 cubic inches. Since point A is midway between points B and C, the distance between the center of pivot bearing 172 and rod bearing 134 (e. g. points A and B for the 1.0 liter operating level) is always 4.260 inches. Angle G-L-A, which is the angle of inclination θ of the wobble plate line 150 with respect to the plane 152 normal to the centerline of power shaft 108, is calculated to be 6.55 degrees at 1.0 liter engine displacement.

Referring still to FIG. 5, the piston stroke for the engine operating at the (DPmax) 3.0 liter engine displacement level requires a piston stroke of 2.914 inches. For the engine to maintain a constant pressure ratio, the combustion chamber volume at the top of piston stroke is required to be 9.625 cubic inches. As explained earlier, a combustion chamber volume of 9.625 cubic inches requires that the top of the piston stroke be 0.511 inches below the top of the cylinder. Thus, the hypothetical location of rod bearing 134 at the top of the stroke for the 3.0 liter engine displacement is shown in FIG. 5 as point D. Adding the required piston stroke length of 2.914 inches gives the rod bearing 134 location at the bottom of the stroke, which is shown as point E. The location of the pivot bearing 172 at the 3.0 liter operating level is shown as point F. The angle G-J-F, which is also the angle of inclination θ of the wobble plate line 150 with respect to the plane 152 normal to the centerline of power shaft 108 at the 3.0 liter engine displacement, is 20.00 degrees.

Accordingly, the distance between point A and point F is 1.482 inches, and this is the distance that support collar 171/pivot axis 146 must travel for the engine displacement to go from 1.0 liter to 3.0 liters engine displacement while maintaining a constant compression ratio. A linear relationship between collar travel and engine displacement results in a hypothetical location of bearing pivot axis at point G, i.e., 2.223 inches above point F, that will produce zero displacement. This location is also known as the theoretical zero displacement point 170.

A mechanism can now be defined that will maintain constant compression ratio as engine displacement is varied between DPmin of 1.0 liters and DPmax of 3.0 liters. Using the 3.0 liter operating level for analysis, a straight line passing through points D and E represents a plane in the non-rotating second ring portion 142 and the rotating first ring portion 140 in FIG. 3. A control link 178 is therefore constructed between the upper bearing 182 on the upper collar 180 and the control bearing 176 on the first ring portion 140. The center of the upper bearing 182 is located at point G, and point H represents the center of the control bearing 176 of the control link 178. The location of point H on the line between point D and point E is determined by drawing a line from point G to point H so that the angle H-F-G is the same magnitude as angle H-G-F. By similarity, the distance from point G to point H is the same as the distance from point F to point H, which is 3.250 inches. If the line between point E and point D is extended an additional distance of 3.250 inches from point H to point J, it can be shown by similarity that point J lies on a plane perpendicular to the centerline of power shaft 108 that passes through point G.

If the support collar 171 moves along the power shaft 108 so that the center of bearing 172 (i.e., the pivot axis 146) moves from point F to point A (engine at the 1.0 liter engine displacement), then the linkage similarity relationships still holds, thereby demonstrating that the engine maintains a constant compression ratio. It should also be noted that if the line between points B and C is extended from point K by the same distance as the distance between points A and K to point L, then point L lies on the same line perpendicular to the power shaft as points G and J. This relationship supports the design concept for gears 160 and 166 described in connection with FIG. 3, and further is the basis for an alternate piston control mechanism (Variation 7) described in connection with FIG. 13.

Referring now to FIG. 6-*a* and 6-*b*, the tooth profiles to accommodate different tooth pitch in the anti-rotation assembly 154, e.g., outer rim teeth 160 and the ring gear 166, in FIG. 3 are calculated using the previously defined engine design parameters that serve as a basis for design process example. An example of tooth profiles that will meet the requirement for different tooth pitches in parts 160 and 166 are derived in the following description. The derivation is illustrated in FIG.

6-*a* and 6-*b* for the engine operating at 3.0 liters piston displacement as shown in FIG. 3.

Referring first to FIG. 6-*a*, a first imaginary circular plane (denoted A) passing through the centers of the pivot bearing 172 and the control bearing 176 in FIG. 3 is shown. A second circular plane (denoted B) is perpendicular to the power shaft axis 112 (denoted C) and passes through the center of upper bearing 182. The point of intersection (denoted D) of these two planes A and B represents the reference plane for engagement of the teeth on parts 160 and 166 in FIG. 3. The distance from point D to the power shaft centerline C defines the radii of planes A and B. The point of intersection D traverses a complete circle normal to the power shaft axis 112 as the power shaft 108 rotates one turn.

Referring still to FIG. 6-*a*, the first circular plane A is inclined 20 degrees with respect to the second circular plane B. For the baseline 3.0 liter engine of this example, the radius of the first plane A is 6.50 inches and the radius of the second plane B is 6.0 inches. In order for the angle of rotation for the non-rotating second ring portion 142 to be zero, the point of intersection (for the planes A and B) traverses a circle at the same rotational speed as the power shaft 108. The edge of the first plane A thus represents the line of contact for the gear teeth 160 on the rim 162 of the second ring portion 142 and the edge of plane B represents a line of contact for teeth 164 on the ring gear 166. There must be the same number of teeth on the outer rim 162 and the ring gear 166. For this example each "gear" has 60 teeth (one every 6 degrees) and a total height of 0.2 inches (contact line +/−0.1 inches.) The requirement for equal number of teeth means that the tooth pitch on the outer rim 162 and the ring gear 166 are not the same. Such operation is possible only if the differences in tooth pitch are small and the number of teeth engaged at any one time is also sufficiently small. The example given here is for the maximum difference in radii for the outer rim 162 and the ring gear 166, which occurs at the maximum cylinder displacement as illustrated.

Referring now also to FIG. 6-*b*, compatible tooth profiles for the teeth on the outer rim 162 and the ring gear 166 were calculated by comparing the tooth locations near the contact point of planes A and B (of FIG. 6-*a*). A tooth profile is assumed for one set of teeth. The tooth profile for the second set of teeth can then be calculated. The reference points for this calculation were the center of each tooth tip in the region of interaction between the teeth near the point of intersection D of the two planes A and B. The analysis was accomplished with the tip of the outer rim 162 tooth assumed to be circular with a radius of 0.1 inches (not optimized). The required profile for the teeth on ring gear 166 was calculated as a function of the distance from the point of intersection. The results in a plane normal to and adjacent to the edge of plane B are shown in FIG. 6-*b*. The sides of the teeth on ring gear 166 are defined by the motion of the circular tips of the non-rotating outer rim 162 teeth. The base of the teeth on outer rim 162 only have to be narrow enough to not interfere with the sides of the teeth on ring gear 166.

As the power shaft turns and the contact point progresses to the right, more teeth are engaged to the right of the illustration and an equal number of teeth are disengaged in the left portion of the illustration. Since there are the same number of teeth on outer rim "gear" 162 and ring gear 166, the point of contact rotates with the same angular rate as the power shaft even though the radii of the ring gear 166 and outer rim gear 162 are not the same. This relationship assures that the outer rim gear 162 (and thus, the second ring portion 142 of the wobble plate assembly) does not rotate.

Variations to the First Exemplary Embodiment

Although a first example embodiment of the apparatus, method and system of the present invention has been illustrated in the accompanied drawings and described in the foregoing detailed description, it is understood that other variations, numerous rearrangements, modifications and substitutions can be made without departing from the spirit and the scope of the invention as presented.

Figure 7:
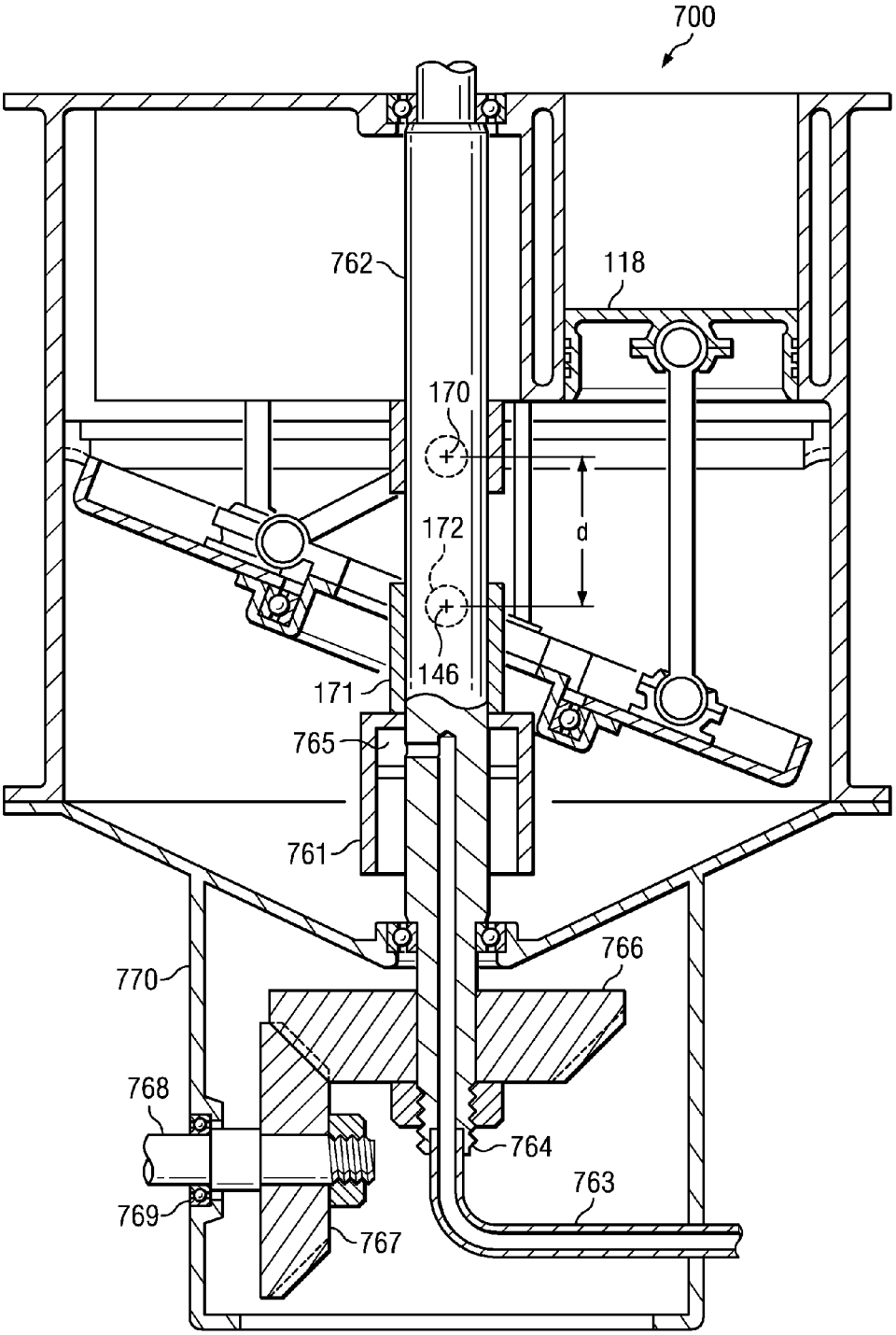
FIG. 7 is a cross-sectional side view of an engine block portion of an engine according to another embodiment ("first variation") illustrating aspects of a hydraulic displacement actuator.

Additional embodiments are now presented, wherein variations to the first example embodiment are described Variation One—Use of a Hydraulic Piston to Vary Displacement Referring now to FIG. 7, there is illustrated an alternative variable displacement engine 700 similar in many respects to the engine 100 described in connection with FIGS. 1-4. Only the elements that differ substantially from those describe in FIGS. 1-4 are renumbered.

Variable displacement engine 700 includes a displacement actuator comprising a hydraulic piston 761, rather than the mechanical screw jack mechanism shown in FIG. 3. The piston 761 moves the support collar 171 and pivot bearing 172 in the axial direction along the modified power shaft 762 to increase or decrease the engine displacement. In the embodiment illustrated, the natural forces of pressure on the pistons 118 move the piston control mechanism down to increase displacement. To move the pistons upward and decrease displacement, high-pressure hydraulic fluid flows through the supply tube 763, through a rotary seal 764, through a passage in the power shaft 762 and into the upper cavity of the piston 765. If the fluid supply valve closes so that hydraulic fluid flow is prevented, then the piston 761 remains stationary and the engine displacement is constant. The hydraulic fluid supplied to the piston 761 is regulated by a mechanical and/or electronic engine control.

The fluid enters the power shaft 762 at the bottom end so that the high pressure fluid seal will be as small as possible and the passage in the power shaft is reasonably short. Bevel gears 766 and 767 provide a means to transmit power from the power shaft 762 to a location outside of the engine. Bevel gear 767 is supported by drive shaft 768 and bearing 769. The bearing 769 is supported by an extension of the lower block cover 770.

Variation Two—Replacement of Cams with Hydraulically Driven Valve Actuators

Figure 8:
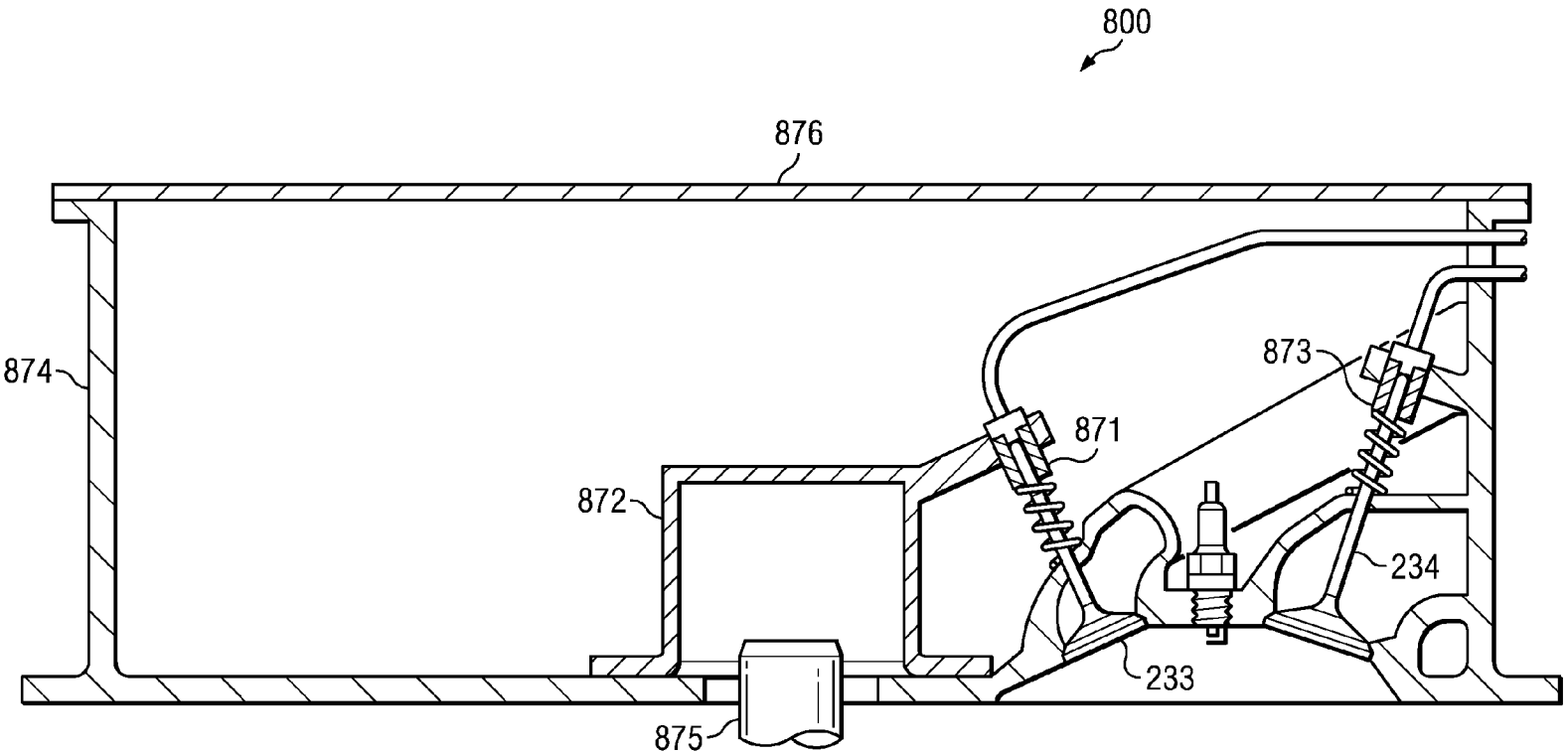
FIG. 8 is a cross-sectional side view of a cylinder head portion of an engine according to another embodiment ("second variation") illustrating aspects of hydraulic valve actuators.

Referring now to FIG. 8, there is illustrated an alternative variable displacement engine 800 similar in many respects to the engine 100 described in connection with FIGS. 1-4. Only the elements that differ substantially from those describe in FIGS. 1-4 are renumbered.

Variable displacement engine 800 includes hydraulically driven actuators for operation of the intake valves 233 and the exhaust valves 234. A hydraulic actuator 871 opens intake valve 233 for piston 1. A similar actuator is required for each of the remaining intake valves, but these are not shown for clarity. The actuator 871 is held in place by support structure 872. A hydraulic actuator 873 opens the exhaust valve 234 for piston 1. Similar actuators operate the remainder of the exhaust valves. The actuators 873 are supported by extensions from a modified cylinder head 874. The cylinder head 874 is the same as cylinder head 231 in FIG. 4 except for addition of the supports for exhaust valve actuators 873 and deletion of supports for exhaust valve rockers 242 in FIG. 3. High pressure hydraulic fluid used to operate the hydraulic actuators is scheduled by a mechanical and/or electronic engine control. This type of valve operation permits variation in valve timing, valve travel, valve open time and rate at which the valves open and close.

As noted by a comparison of FIG. 8 and FIG. 4, the use of hydraulic valve actuators 871, 873 may greatly reduce the number of parts and complexity of the mechanism contained in the cylinder head of an embodiment which uses cams for valve actuation. The extension of the power shaft 108 into the head is no longer necessary and a shortened power shaft 875 is shown in FIG. 8. A flat head cover 876 is shown in FIG. 8 rather than the domed design 249 shown in FIG. 4.

Variation Three—Use of Hydraulic Actuation for Both Displacement Actuator (Piston Control Mechanism) and Valve Operation This variation (not shown) combines the features of engines 700 and 800. All actuators, e.g., 761, 871 and 873, may use the same source of high pressure hydraulic fluid and/or may be scheduled by a mechanical and/or electronic engine control.

Variation Four—Use of Slots and Sliding Mechanism to Control Connecting Rod Motion Referring now to FIG. 9, there is illustrated an alternative variable displacement engine 900 similar in many respects to the engine 100 described in connection with FIGS. 1-4. Only the elements that differ substantially from those describe in FIGS. 1-4 are renumbered.

Figure 9:
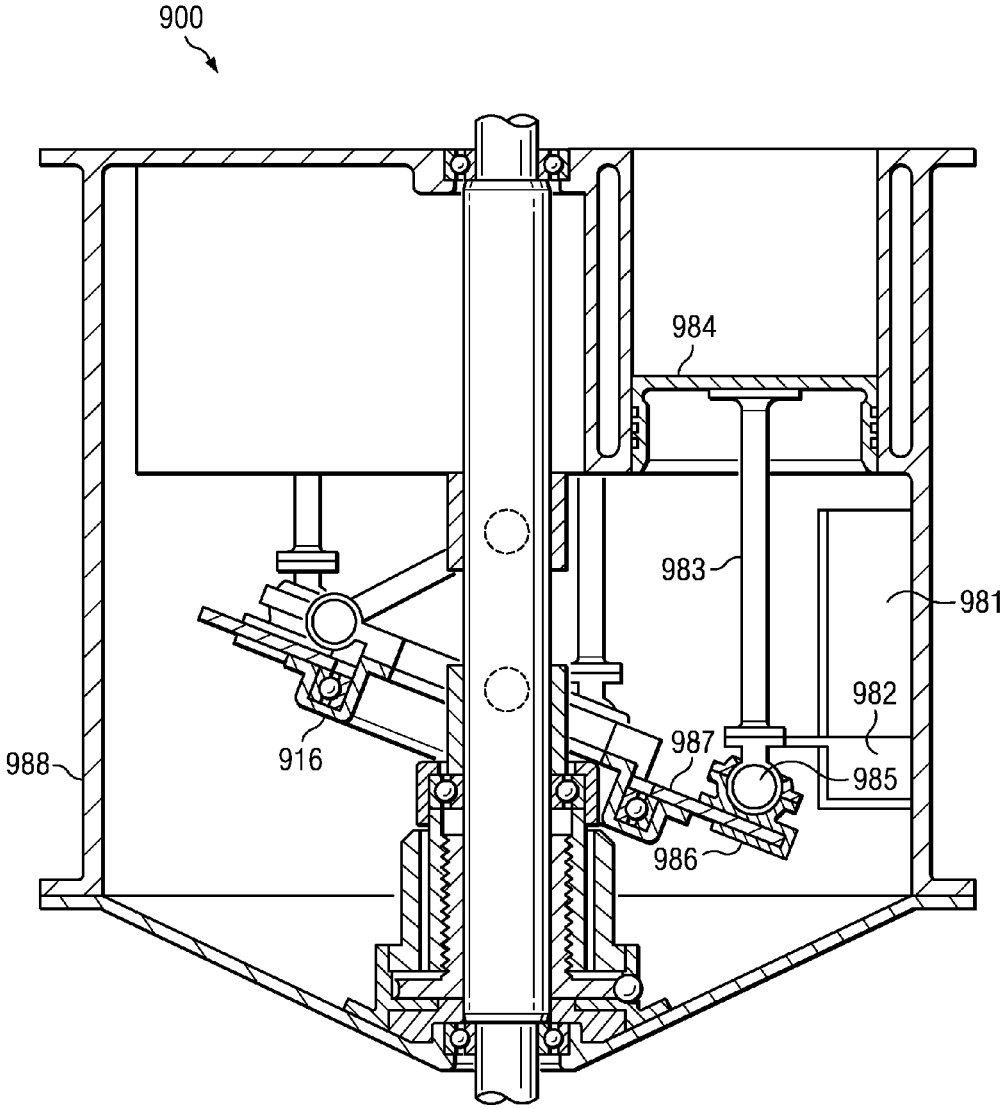
FIG. 9 is a cross-sectional side view of an engine block portion of an engine according to another embodiment ("fourth variation") illustrating aspects of an alternative connecting rod configuration.

Variable displacement engine 900 includes a rectangular vertical slot 981 and a slider mechanism 982 to restrict the lower end of a connecting rod 983 to motion parallel to the centerline of power shaft 108 as shown in FIG. 9 for piston 1. For this variation, the upper connecting rod bearing 132 (of FIG. 3) is no longer necessary and the connecting rod 983 is firmly attached to a piston 984. The only difference between the piston 984 and the piston 110 (of FIG. 3) is the method of joining the connecting rod to the piston. The lower end of connecting rod 983 is connected firmly to the upper surface of the arm of slider 982. The lower side of the arm of slider 982 is a spherical bearing 985. Bearing 985 connects slider 982 to a second slider mechanism 986. The changes described for piston one also apply to the remaining pistons.

The slider 986 is permitted to slide freely on a flat plate 987. The flat plate 987 takes the place of the second ring portion 142 of the wobble plate assembly 128 (piston control mechanism) shown in FIG. 3. In some embodiments, the plate 987 may be made a rotating part by eliminating the bearing 916, while in other embodiments bearing 916 is used to allow it to rotate freely. Allowing it to rotate freely will result in minimum friction due to natural processes. The rest of the piston control mechanism described in FIG. 3 remains unchanged, except that a ring gear 166 (FIG. 3) is not needed. Slot 981 can be made a part of cylinder block 988 or attached to it.

Variation 5—Use of a Universal Joint Mechanism in the Anti-Rotation Assembly and Displacement Actuator Referring now to FIGS. 10-12, there is illustrated an alternative variable displacement engine 1000 similar in many respects to the engine 100 described in connection with FIGS. 1-4. Only the elements that differ substantially from those describe in FIGS. 1-4 are renumbered. The variable displacement engine 1000 includes a universal joint ("U-joint") mechanism in the anti-rotation assembly rather than the ring gear 166 and mating outer lip "gear" portion 162 in FIG. 3, and also as part of the displacement actuator.

Figure 10:
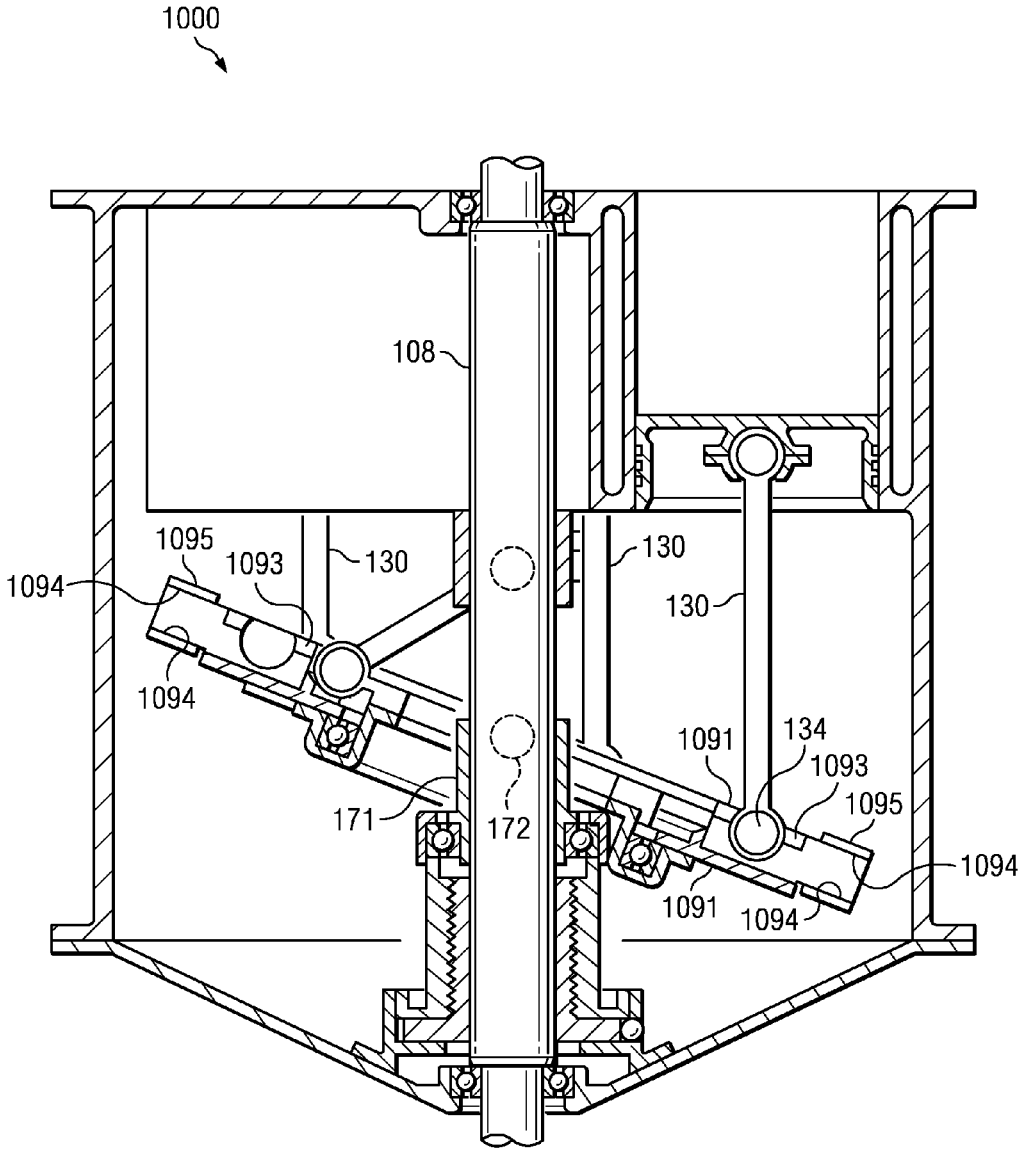
FIG. 10 is a cross-sectional side view, taken along line 10-10 of FIG. 11, of an engine block portion of an engine according to another embodiment ("fifth variation") illustrating aspects of a universal joint anti-rotation mechanism.
Figure 11:
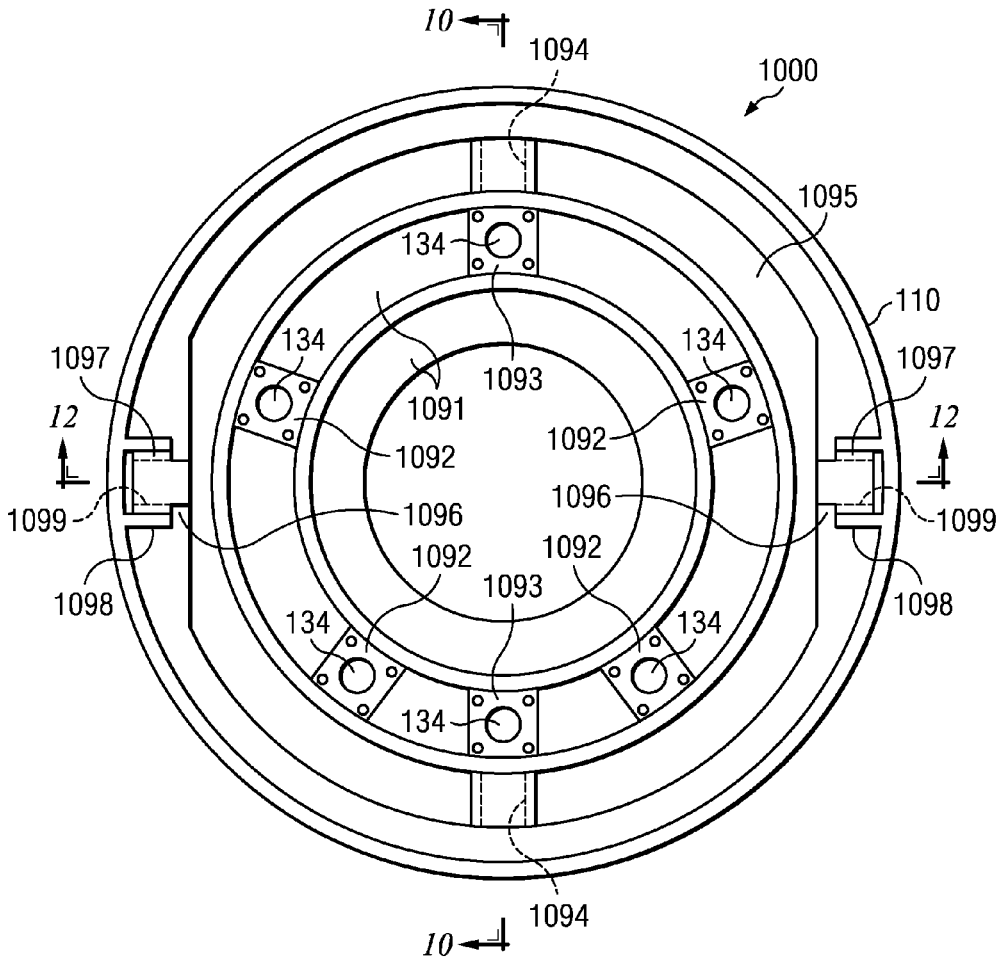
FIG. 11 is a partial top view of the engine of FIG. 10, further illustrating aspects of the anti-rotation mechanism.

Referring first to FIGS. 10 and 11, the wobble plate assembly 128 of FIG. 3 is modified to accommodate a U-joint mechanism comprising four connecting rod bearing blocks 1092 and two connecting rod bearing blocks 1093 (best seen in FIG. 11). The two parts 1093 are mounted opposite to each other on second ring portion 1091. The four bearing blocks 1092 and one bearing block 1093 are attached to the five connecting rods 130 by bearings 134.

Cylindrical extensions on the outer side of bearing blocks 1093 form the inner surface of bearings 1094 shown in FIGS. 10 and 11. The bearings 1094 connect the bearing blocks 1093 to a differential ring 1095 as shown in FIGS. 10 and 11. FIG. 11 shows a top view of part 1095.

Two cylindrical bearing extensions 1096 (FIG. 11) are located on the exterior side of the differential ring 1095. These extensions 1096 are each located 90 degrees from the two bearings 1094. Bearings 1099 attach the differential ring 1095 to a support structure 1097 as shown in FIGS. 11 and 12.

Figure 12:
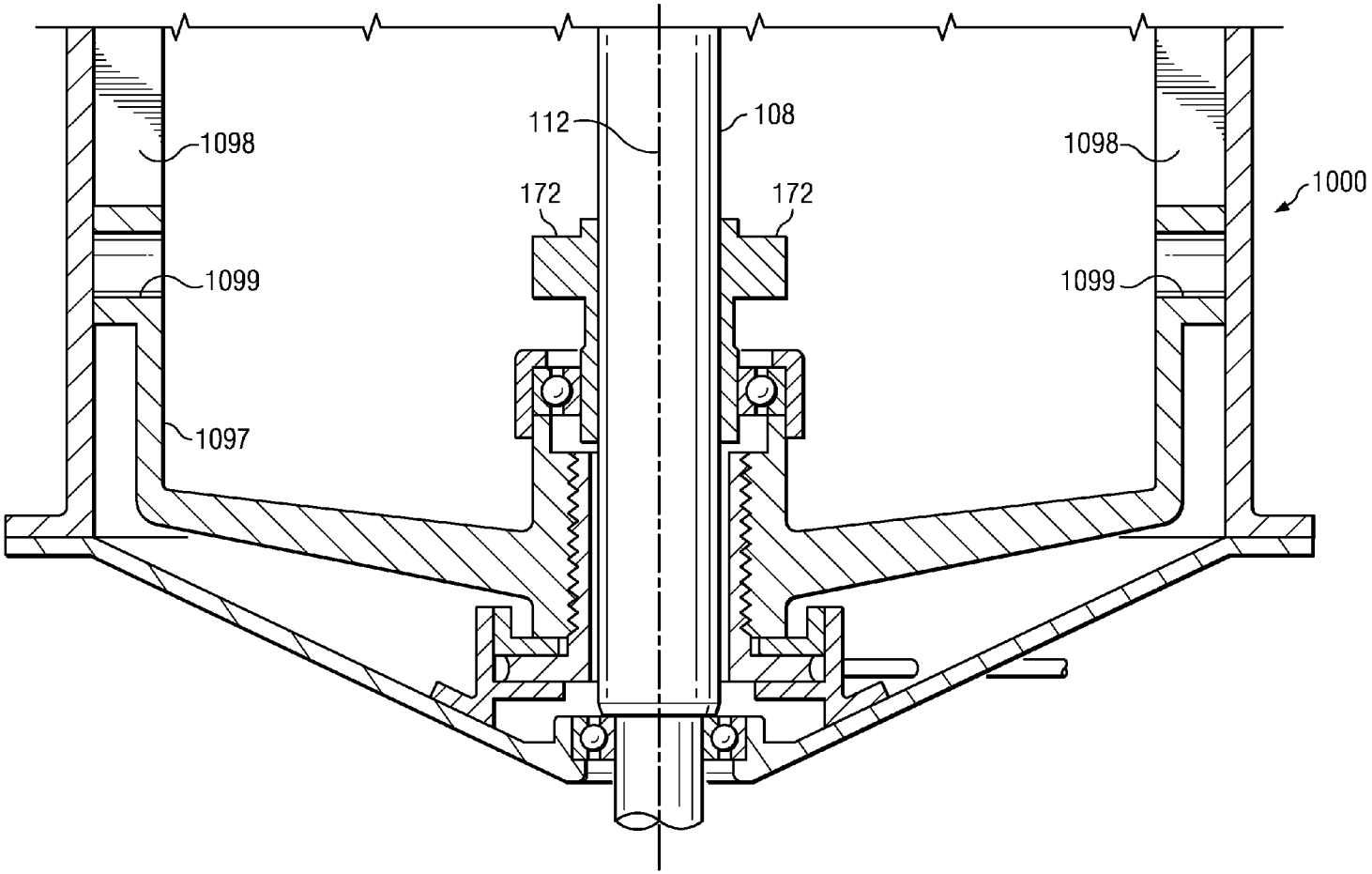
FIG. 12 is a partial cross-sectional side view of the engine of FIG. 10, taken along line 12-12 of FIG. 11, still further illustrating aspects of the anti-rotation mechanism.

Referring now to FIG. 12, the support structure 1097 is shown in detail. Note that the view of FIG. 12 is turned 90 degrees from that of FIG. 10. The structure 1097 is not visible in FIG. 10 since it is hidden from view by the power shaft 108. Note that the support structure 1097 moves along power shaft 108 in concert with the support collar 171 in FIG. 10. Support structure 1097 helps stabilize the U-joint ring 1094 and assure that the centerlines of the bearings 1099 and the pivot bearings 172 are always in the same plane normal to the centerline 112 of the power shaft 108. Guide slots 1098 in the cylinder block prevent rotation of the support structure 1097 and permit the arms of the support structure 1097 surrounding the bearings 1099 to move only in a direction parallel to the centerline 112 of the power shaft 108. Since the support structure 1097 is connected to the part 1091 as shown in FIG. 11, the part 1091 is also prevented from rotating.

The lift cylinder 198 and the housing 200 of the screw jack mechanism 186 in FIG. 3 are reconfigured as integral parts of the support structure 1097 in this embodiment as shown in FIG. 12. The rest of the screw jack mechanism 186 may be the same as shown in FIG. 3.

Variation 6—Use of a Constant Velocity Joint (CV-Joint) in the Anti-Rotation Assembly This variation (not shown) substitutes a constant velocity joint (similar to the concept used to power front-wheels in automobiles) for the U-joint of engine 1000. Details of the constant velocity joint mechanism are not shown.

Variation 7—Use of an Arm and a Track in the Piston Control Linkage

Figure 13:
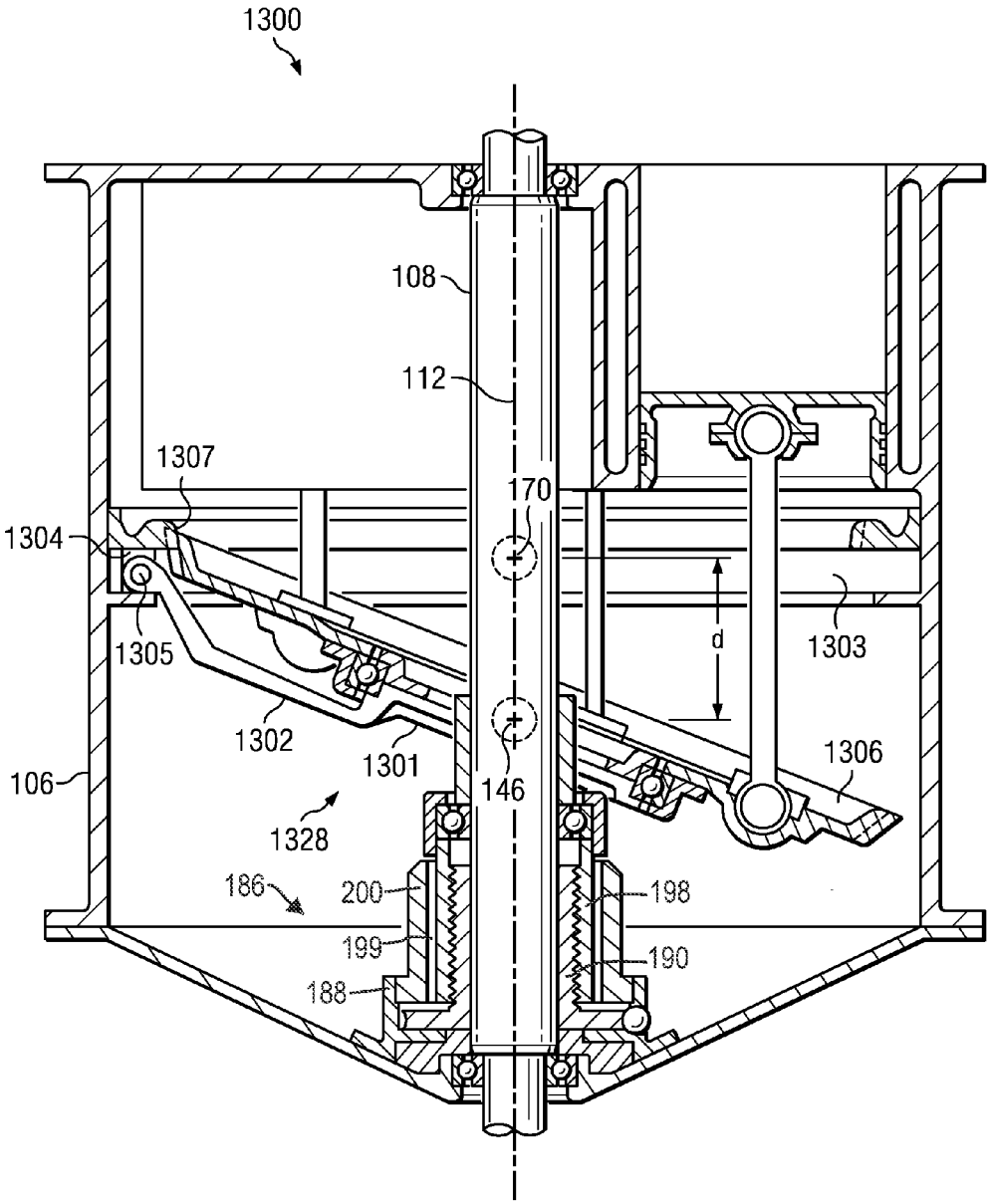
FIG. 13 is a cross-sectional side view of an engine block portion of an engine according to another embodiment ("seventh variation") illustrating aspects of an alternative piston control linkage.

Referring now to FIG. 13, there is illustrated an alternative variable displacement engine 1300 similar in many respects to the engine 100 described in connection with FIGS. 1-4. Only the elements that differ substantially from those describe in FIGS. 1-4 are renumbered.

Within the description of the variable displacement engine 100, it was shown that a specific extension of the second ring portion 142, specifically the teeth on the outer rim portion 162, always remained in a single plane perpendicular to the power shaft 108 (see also FIG. 5 and related description). This variable displacement engine 1300 takes advantage of that feature to provide an alternate design of the piston control mechanism.

The variable displacement engine 1300 comprises a wobble plate assembly 1328 that includes a first ring portion 1301 rather than the first ring portion 140 shown in FIG. 3. An extension (arm) 1302 extends from the ring portion 1301 to a circular track 1303 that is normal to the axis of power shaft 108 and adjacent to the inner wall of cylinder block 106. In the illustrated embodiment, the track 1303 is a slot. A follower assembly 1304 is attached the outer end of arm 1302 by a bearing 1305 and is configured to follow the path of the track 1303. In the illustrated embodiment, the follower assembly 1304 is a bearing block. As the power shaft 108 rotates, the bearing block 1304 traverses a circular path in the slot 1303. The length of arm 1302 is determined by the distance required to reach the plane normal to power shaft 108 that results in a constant compression ratio as the engine displacement is varied. This plane is shown in FIG. 5 as the line passing through points G-J-L. The centerline of the bearing 1305 always stays in this plane.

In the engine 1300 of the current embodiment, the control bearings 176, control link 178 and upper bearing 182 of engine 100 in FIG. 3 are no longer required. The upper collar 180, which is fixed to power shaft 108, is no longer required as a part of the piston control mechanism, but may be retained as a mechanical stop to limit minimum engine displacement. The second ring portion 142 in FIG. 3 is replaced by second ring portion 1306 to accommodate clearances for the arm 1302 and revised gear tooth profiles at its outer rim. A ring gear 1307 replaces the ring gear 166 in FIG. 3 to accommodate the revised gear tooth profiles. Other significant features of the engine design are unchanged from the engine 100.

In yet another embodiment (not shown) similar to that of engine 1300 in FIG. 13, a variable displacement engine 1400 comprises a circular track 1403 disposed on the engine block 106 to define an offset control plane that is oriented normal to the longitudinal axis 112 and intersects the longitudinal axis at an offset distance Y from the theoretical zero displacement point 170. A follower assembly 1404 including a follower operatively engages the track 1403 to constrain the motion of the follower to the offset control plane. An extension arm 1402 is operatively connected to a first ring portion 1401 of the wobble plate assembly so as to have a distal end positioned along a line parallel to, but longitudinally offset by the distance Y from, the wobble plate inclination plane. The extension arm 1402 is connected at the distal end to the follower assembly and causes the follower assembly to traverse the circular track as the power shaft 108 rotates. The extension arm 1402 is configured such that the distal end is positioned, when viewed in a direction parallel to the pivot axis 146, along the line parallel to, but longitudinally offset by a distance Y from, the wobble plate inclination plane.

It will be appreciated by those skilled in the art having the benefit of this disclosure that this engine provides a continuously variable displacement while maintaining a constant compression ratio over the range of displacements. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An engine comprising:

an engine block;

an elongated power shaft rotatably supported by the engine block, the power shaft having a longitudinal axis and being fixed longitudinally relative to the engine block;

at least one cylinder supported by the engine block, each cylinder having a bore defining a bore axis aligned substantially parallel to the longitudinal axis of the power shaft;

one or more pistons corresponding in number to the number of the cylinders, each respective piston being slidably disposed within the bore of a respective cylinder;

a wobble plate assembly having a generally annular configuration defining a central opening through which central opening the power shaft passes, the wobble plate assembly including a central support member, a first ring portion, a second ring portion and a ring bearing assembly, the central support member being longitudinally slidably mounted on the power shaft to be movable in the longitudinal direction independently from the power shaft and defining a pivot axis for the wobble plate assembly, the pivot axis intersecting the longitudinal axis of the power shaft in a perpendicular orientation and rotating with the power shaft and moving in the longitudinal direction with the central support member independently from the power shaft, the first ring portion being pivotally mounted on the central support member such that the first ring portion pivots about the pivot axis and rotates with the central support member, the second ring portion being concentrically disposed adjacent the first ring portion and having mounted thereon one or more connecting rod bearings corresponding in number to the number of the cylinders, the ring bearing assembly being connected between the first ring portion and the second ring portion so as to allow the first ring portion to rotate about the common center relative to the second ring portion while constraining the second ring portion to remain parallel to the first ring portion, the wobble plate assembly, when viewed in a direction parallel to the pivot axis, defining a wobble plate inclination plane and a wobble plate inclination angle θ, the wobble plate inclination plane being a line passing through the center of the pivot axis and the center of the connecting rod bearing(s), when viewed in a direction parallel to the pivot axis, the wobble plate inclination angle θ being the angle of intersection between the wobble plate inclination plane and a line perpendicular to the longitudinal axis of the power shaft, when viewed parallel to the pivot axis;

a displacement actuator operatively connected between the engine block and the central support member, the displacement actuator selectively moving the central support member with the pivot axis of the wobble plate assembly in the longitudinal direction along the power shaft so as to longitudinally position the pivot axis of the wobble plate assembly at a user-selectable distance d from a theoretical zero displacement point on the longitudinal axis, the theoretical zero displacement point being disposed longitudinally between the pivot axis and the one or more pistons;

a piston control linkage operatively connected from a first anchor point disposed on a zero displacement line running through the theoretical zero displacement point perpendicular to the longitudinal axis of the power shaft to the wobble plate assembly, the piston control linkage setting the wobble plate inclination angle θ as the distance d changes so as to maintain a linear relationship between d and sin(θ);

an anti-rotation assembly having a first portion operatively connected to the second ring portion of the wobble plate assembly and a second portion operatively connected to the engine block, the anti-rotation assembly preventing rotation of the second ring portion of the wobble plate assembly relative to the engine block;

one or more connecting rods corresponding in number to the number of cylinders, each respective connecting rod having an upper end connected to a respective piston and a lower end connected to a respective connecting rod bearing on the second ring member of the wobble plate assembly such that reciprocation of the piston(s) within the cylinder bore(s) results in rotation of the power shaft; and whereby operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

2. An engine in accordance with claim 1, wherein the piston control linkage further comprises:

a first control bearing disposed at the first anchor point and operatively connected to the power shaft, the center of the first control bearing defining a control axis oriented parallel to the pivot axis of the wobble plate assembly and intersecting the longitudinal axis of the power shaft in a perpendicular orientation at the theoretical zero displacement point, the control axis rotating with the power shaft to remain parallel to the pivot axis;

a second control bearing connected to the first ring portion of the wobble plate assembly, the center of the second control bearing, when viewed in a direction parallel to the pivot axis of the wobble plate assembly, being disposed along the wobble plate inclination plane and being offset from the pivot axis by a distance OD1; and a control link connected between the first control bearing and the second control bearing, the control link having a length, measured between the centers of the first control bearing and the second control bearing, equal to the offset distance OD1.

3. An engine in accordance with claim 2, wherein:

the first control bearing is mounted on a collar fixedly connected to the power shaft; and the length of the control link OD1=(dmax/2)/sin(θmax), where dmax is the distance between the pivot axis of the wobble plate assembly and the theoretical zero displacement point at the maximum engine displacement and Amax is the wobble plate inclination angle at the maximum engine displacement.

4. An engine comprising:

an engine block;

an elongated power shaft rotatably supported by the engine block, the power shaft having a longitudinal axis;

at least one cylinder supported by the engine block, each cylinder having a bore defining a bore axis aligned substantially parallel to the longitudinal axis of the power shaft;

one or more pistons corresponding in number to the number of the cylinders, each respective piston being slidably disposed within the bore of a respective cylinder;

a wobble plate assembly having a generally annular configuration defining a central opening through which central opening the power shaft passes, the wobble plate assembly including a central support member, a first ring portion, a second ring portion and a ring bearing assembly, the central support member being longitudinally slidably mounted on the power shaft and defining a pivot axis for the wobble plate assembly, the pivot axis intersecting the longitudinal axis of the power shaft in a perpendicular orientation and rotating with the power shaft, the first ring portion being pivotally mounted on the central support member such that the first ring portion pivots about the pivot axis and rotates with the central support member, the second ring portion being concentrically disposed adjacent the first ring portion and having mounted thereon one or more connecting rod bearings corresponding in number to the number of the cylinders, the ring bearing assembly being connected between the first ring portion and the second ring portion so as to allow the first ring portion to rotate about the common center relative to the second ring portion while constraining the second ring portion to remain parallel to the first ring portion, the wobble plate assembly, when viewed in a direction parallel to the pivot axis, defining a wobble plate inclination plane and a wobble plate inclination angle θ, the wobble plate inclination plane being seen as a line passing through the center of the pivot axis and the center of the connecting rod bearing(s), when viewed in a direction parallel to the pivot axis, the wobble plate inclination angle θ being the angle of intersection between the wobble plate inclination plane and a line perpendicular to the longitudinal axis of the power shaft, when viewed parallel to the pivot axis;

a displacement actuator operatively connected between the engine block and the central support member, the displacement actuator selectively moving the central support member along the power shaft so as to longitudinally position the pivot axis of the wobble plate assembly at a user-selectable distance d from a theoretical zero displacement point on the longitudinal axis;

a piston control linkage operatively connected to the wobble plate assembly, the piston control linkage setting the wobble plate inclination angle θ as the distance d changes so as to maintain a linear relationship between d and sin(θ) such that d=W·sin(θ), where W is a constant;

an anti-rotation assembly having a first portion operatively connected to the second ring portion of the wobble plate assembly and a second portion operatively connected to the engine block, the anti-rotation assembly preventing rotation of the second ring portion of the wobble plate assembly relative to the engine block;

one or more connecting rods corresponding in number to the number of cylinders, each respective connecting rod having an upper end connected to a respective piston and a lower end connected to a respective connecting rod bearing on the second ring member of the wobble plate assembly such that reciprocation of the piston(s) within the cylinder bore(s) results in rotation of the power shaft; and whereby operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin;

wherein the piston control linkage further comprises a circular track disposed on the engine block, the track defining a control plane oriented normal to the longitudinal axis and intersecting the longitudinal axis at an offset distance OD3 from the theoretical zero displacement point;

a follower assembly including a follower center, the follower assembly operatively engaging the track to constrain the motion of the follower center to the control plane;

an extension arm operatively connected to the first ring portion of the wobble plate assembly so as to have a distal end positioned along a line parallel to, but longitudinally offset by a distance OD3 from, the wobble plate inclination plane, the extension arm being connected at the distal end to the follower assembly and causing the follower assembly to traverse the circular track as the power shaft rotates, the extension arm configured such that the follower center is positioned, when viewed in a direction parallel to the pivot axis, along the line parallel to, but longitudinally offset by a distance OD3 from, the wobble plate inclination plane at an offset distance OD2 from the pivot axis.

5. An engine in accordance with claim 4, wherein:

the circular track comprises a slot formed adjacent to an inner wall of the engine block;

the follower assembly comprises a bearing block configured to engage the slot and carry the follower center; and the offset distance OD2=dmax/sin(θmax), where dmax is the distance between the pivot axis of the wobble plate assembly and the theoretical zero displacement point at the maximum engine displacement and θmax is the wobble plate inclination angle at the maximum engine displacement.

6. An engine in accordance with claim 4, wherein the displacement actuator comprises a screw jack mechanism.

7. An engine in accordance with claim 6, wherein the jack screw mechanism of the displacement actuator further comprises:

an inner collar rotatably mounted around the power shaft, the inner collar including a disk portion bearing against the engine block and having a toothed periphery, and a barrel portion connected to the disk portion and having external threads;

an external gear engaging the toothed periphery of the inner collar and operable to selectively rotate the inner collar;

an outer collar mounted around the inner collar, the outer collar including a bearing surface operatively connected to the central support member to position the central support member along the power shaft, a restraining element operatively connected to the engine block to prevent rotation of the outer collar, and an internally threaded portion operatively engaging the external threads of the inner collar such that relative rotation between the inner and outer collars causes relative longitudinal movement between the inner and outer collars;

whereby selective rotation of the external gear moves the central support member along the power shaft.

8. An engine in accordance with claim 4, wherein the displacement actuator comprises a hydraulic jack mechanism.

9. An engine in accordance with claim 8, wherein the hydraulic jack mechanism of the displacement actuator further comprises:

a jack piston slidably mounted around the power shaft, the jack piston including a bearing surface operatively connected to the central support member to position the central support member along the power shaft, and a fluid cavity defined within the jack piston, the cavity having a first internal surface operatively connected to the bearing surface and an opposing internal surface operatively connected to the engine block;

a fluid supply channel having a first end operatively connected to the fluid cavity and a second end operatively connected to a fluid source selectively supplying and releasing pressurized fluid;

whereby selectively supplying and releasing pressurized fluid to/from the cavity moves the central support member along the power shaft.

10. An engine in accordance with claim 4, wherein the anti-rotation assembly comprises:

a ring gear fixedly mounted on the engine block proximate a plane oriented normal to the longitudinal axis and intersecting the longitudinal axis at the theoretical zero displacement point, the ring gear including a plurality of teeth; and a plurality of teeth formed on an outer rim of the second ring portion of the wobble plate assembly;

wherein at least some of the plurality of teeth of the outer rim of the second ring portion are continuously engaging at least some of the plurality of teeth on the ring gear so as to prevent relative rotation between the outer rim portion and the engine block.

11. An engine in accordance with claim 4, wherein:

the anti-rotation assembly comprises a universal joint mechanism including a first pair of cylindrical bearings extending from the second ring portion along a first joint line passing through the center of the second ring portion;

a first universal frame rotatably attached to the first pair of cylindrical bearings and having a second pair of cylindrical bearings extending there from along a second joint line passing through the center of the second ring portion and oriented perpendicular to the first joint line;

a second universal frame rotatably attached to the second pair of cylindrical bearings and slidably mounted to the engine block to prevent rotation of the second universal frame; and the universal joint mechanism forms a portion of the operative connection of the displacement actuator between the engine block and the central support member, the displacement actuator selectively moving the second universal frame longitudinally within the engine block so as to move the central support member longitudinally along the power shaft.

12. An engine comprising:

an engine block supporting a plurality of cylinders spaced apart around a rotatably mounted central power shaft having a longitudinal axis and being fixed longitudinally relative to the engine block, each respective cylinder having a respective bore defining a bore axis aligned substantially parallel to the longitudinal axis and having a respective piston slidably disposed therein, each respective piston having connected thereto an upper end of a respective connecting rod also having a lower end;

a wobble plate assembly longitudinally slidably mounted on the power shaft to be selectively movable in the longitudinal direction independently of the power shaft, the wobble plate assembly including a first ring portion, a second ring portion and a ring bearing assembly, the first ring portion being operatively mounted on the power shaft such that the first ring portion rotates with the power shaft and pivots about a pivot axis intersecting the longitudinal axis of the power shaft in a perpendicular orientation and rotating with the power shaft, the second ring portion being concentrically disposed adjacent the first ring portion and having mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block;

the ring bearing assembly being connected between the first ring portion and the second ring portion so as to allow the first ring portion to rotate about the common center relative to the second ring portion while constraining the second ring portion to remain parallel to the first ring portion, whereby reciprocation of the pistons within the cylinder bores results in rotation of the power shaft; and the wobble plate assembly, when viewed in a direction parallel to the pivot axis, defining a wobble plate inclination plane and a wobble plate inclination angle θ, the wobble plate inclination plane being a line passing through the center of the pivot axis and the center of the connecting rod bearings, when viewed in a direction parallel to the pivot axis, the wobble plate inclination angle θ being the angle of intersection between the wobble plate inclination plane and a line perpendicular to the longitudinal axis of the power shaft, when viewed parallel to the pivot axis;

a displacement actuator operatively connected between the engine block and the wobble plate assembly, the displacement actuator selectively moving the wobble plate assembly longitudinally along the power shaft so as to longitudinally position the pivot axis at a user-selectable distance d from a theoretical zero displacement point on the longitudinal axis, the theoretical zero displacement point being disposed longitudinally between the pivot axis and the pistons;

a piston control linkage operatively connected from a first anchor point disposed on a zero displacement line running through the theoretical zero displacement point perpendicular to the longitudinal axis of the power shaft to the wobble plate assembly, the piston control linkage setting the wobble plate inclination angle θ as the distance d changes such that $d=W \sin(\theta)$, where W is a constant;

whereby operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin.

13. An engine in accordance with claim 12, wherein the piston control linkage further comprises a two bar link mechanism including:

a first link connected between a first control bearing and a second control bearing, wherein the first control bearing is operatively connected to the power shaft, the center of the first control bearing defining a control axis oriented parallel to the pivot axis of the wobble plate assembly and intersecting the longitudinal axis of the power shaft in a perpendicular orientation at the theoretical zero displacement point, the control axis rotating with the power shaft to remain parallel to the pivot axis, and the second control bearing is connected to the first ring portion of the wobble plate assembly, the center of the second control bearing being disposed, when viewed in a direction parallel to the pivot axis of the wobble plate assembly, along the wobble plate inclination plane;

a second link connected between the second control bearing and the pivot axis of the wobble plate assembly, the second link being fixedly attached to the inner ring portion of the wobble plate assembly;

wherein the first link and the second length have the same length.

14. An engine comprising:

an engine block supporting a plurality of cylinders spaced apart around a rotatably mounted central power shaft having a longitudinal axis, each respective cylinder having a respective bore defining a bore axis aligned substantially parallel to the longitudinal axis and having a respective piston slidably disposed therein, each respective piston having connected thereto an upper end of a respective connecting rod also having a lower end;

a wobble plate assembly mounted on the power shaft, the wobble plate assembly including a first ring portion, a second ring portion and a ring bearing assembly, the first ring portion being operatively mounted on the power shaft such that the first ring portion rotates with the power shaft and pivots about a pivot axis intersecting the longitudinal axis of the power shaft in a perpendicular orientation and rotating with the power shaft, the second ring portion being concentrically disposed adjacent the first ring portion and having mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block;

the ring bearing assembly being connected between the first ring portion and the second ring portion so as to allow the first ring portion to rotate about the common center relative to the second ring portion while constraining the second ring portion to remain parallel to the first ring portion, whereby reciprocation of the pistons within the cylinder bores results in rotation of the power shaft; and the wobble plate assembly, when viewed in a direction parallel to the pivot axis, defining a wobble plate inclination plane and a wobble plate inclination angle θ, the wobble plate inclination plane being seen as a line passing through the center of the pivot axis and the center of the connecting rod bearings, when viewed in a direction parallel to the pivot axis, the wobble plate inclination angle θ being the angle of intersection between the wobble plate inclination plane and a line perpendicular to the longitudinal axis of the power shaft, when viewed parallel to the pivot axis;

a displacement actuator operatively connected between the engine block and the wobble plate assembly, the displacement actuator selectively moving the wobble plate assembly along the power shaft so as to longitudinally position the pivot axis of at a user-selectable distance d from a theoretical zero displacement point on the longitudinal axis;

a piston control linkage operatively connected to the wobble plate assembly, the piston control linkage setting the wobble plate inclination angle θ as the distance d changes such that d=W sin(θ), where W is a constant;

whereby operation of the displacement actuator to selectively change the pivot axis-to-zero point distance d within a range between a maximum distance dmax and a minimum distance dmin, where the ratio of dmax/dmin=N, correspondingly changes the piston displacement DP of the engine within a range between a maximum displacement DPmax and a minimum displacement DPmin having a ratio DPmax/DPmin=N, while the piston control linkage maintains the compression ratio of the engine at a substantially constant value as the displacement changes within the range between DPmax and DPmin wherein the piston control linkage further comprises:

a circular track disposed on the engine block, the track defining a control plane oriented normal to the longitudinal axis;

a follower assembly operatively engaging the track to constrain the motion of the follower assembly to remain along the control plane;

an extension arm mounted on the first ring portion of the wobble plate assembly and connected to the follower assembly, the extension arm causing the follower assembly to traverse the circular track as the power shaft rotates, such that the wobble plate inclination plane rotates as the power shaft rotates.

15. An engine in accordance with claim 14, wherein the engine block is configured with five cylinders equally spaced around the power shaft.

16. An engine in accordance with claim 14, further comprising:

a cylinder head assembly including a plurality of cylinder head portions corresponding in number with the number of cylinders;

one respective cylinder head portion being connected to the upper end of each respective cylinder; and each respective cylinder head portion including at least one intake valve and at least one exhaust valve.

17. An engine in accordance with claim 16, wherein the cylinder head assembly further comprises:

at least one cam shaft operatively connected to the power shaft to rotate at a fixed speed ratio with respect to rotation of the power shaft;

at least two cam bodies mounted on the at least one cam shaft;

the at least two cam bodies being operatively connected to the at least one intake valve and the at least one exhaust valve of each respective cylinder head so as to open and close the valves according to a predetermined pattern.

18. An engine comprising:

an engine block supporting a plurality of cylinders spaced apart around a rotatably mounted central power shaft having a longitudinal axis and being fixed longitudinally relative to the engine block, each respective cylinder having a respective bore defining a bore axis aligned substantially parallel to the longitudinal axis and having a respective piston slidably disposed therein, each respective piston having connected thereto an upper end of a respective connecting rod also having a lower end;

a wobble plate assembly longitudinally slidably mounted on the power shaft to be selectively movable in the longitudinal direction independently of the power shaft, the wobble plate assembly including a first ring portion, a second ring portion and a ring bearing assembly, the first ring portion being operatively mounted on the power shaft such that the first ring portion rotates with the power shaft and pivots about a pivot axis intersecting the longitudinal axis of the power shaft in a perpendicular orientation and rotating with the power shaft, the second ring portion being concentrically disposed adjacent the first ring portion and having mounted thereon a plurality of connecting rod bearings corresponding in number to the number of the cylinders, each respective connecting rod bearing being connected to the lower end of a respective connecting rod, the second ring portion being operatively connected to the engine block so as to prevent the second ring portion from rotating relative to the engine block;

the ring bearing assembly being connected between the first ring portion and the second ring portion so as to allow the first ring portion to rotate about the common center relative to the second ring portion while constraining the second ring portion to remain parallel to the first ring portion, whereby reciprocation of the pistons within the cylinder bores results in rotation of the power shaft; and the wobble plate assembly, when viewed in a direction parallel to the pivot axis, defining a wobble plate inclination plane and a wobble plate inclination angle, the wobble plate inclination plane being a line passing through the center of the pivot axis and the center of the connecting rod bearings, when viewed in a direction parallel to the pivot axis, the wobble plate inclination angle being the angle of intersection between the wobble plate inclination plane and a line perpendicular to the longitudinal axis of the power shaft, when viewed parallel to the pivot axis;

a displacement actuator operatively connected between the engine block and pivot axis, the displacement actuator selectively moving the wobble plate assembly longitudinally along the power shaft so as to longitudinally position the pivot axis within a range of positions along the longitudinal axis;

a piston control linkage operatively connected from a first anchor point disposed on a zero displacement line running perpendicular to the longitudinal axis of the power shaft through a theoretical zero displacement point disposed longitudinally between the pivot axis and the pistons to the wobble plate assembly, the piston control linkage setting the wobble plate inclination angle as the longitudinal position of the pivot axis changes to maintain a constant compression ratio; and whereby operation of the displacement actuator to selectively change the longitudinal position of the pivot axis within a range between a first position and a second position correspondingly changes the piston displacement of the engine within a range between a maximum displacement and a minimum displacement.

19. An engine in accordance with claim 18, wherein the piston control linkage further comprises a two bar link mechanism including:

a first link extending from the pivot axis on the power shaft to a central bearing; and a second link extending from the central bearing to the anchor point, the anchor point defining a control axis on the power shaft, the control axis being parallel to, but spaced apart from, the pivot axis and disposed on the longitudinal axis along the zero displacement line;

wherein a first angle defined between the first link and the longitudinal axis and a second angle defined between the second link and the longitudinal axis have the same magnitude for all positions of the pivot axis.

20. An engine in accordance with claim 19, wherein the displacement actuator further comprises:

an inner collar slidably mounted around the power shaft, bearing against the engine block and having external threads;

an outer collar mounted around the inner collar, operatively supporting the wobble plate assembly and having internal threads operatively engaging the external threads of the inner collar;

whereby selective relative rotation between the inner and outer collars causes relative longitudinal movement between the inner and outer collars to selectively position the central support member along the power shaft.

* * * * *